US007785194B2

(12) United States Patent
Schneider et al.

(10) Patent No.: US 7,785,194 B2
(45) Date of Patent: Aug. 31, 2010

(54) PLAYER SPECIFIC REWARDS

(75) Inventors: Richard J. Schneider, Las Vegas, NV (US); R. Jeffrey Jordan, Las Vegas, NV (US); Scott A. Boyd, Las Vegas, NV (US); Kevan Wilkins, Las Vegas, NV (US); Shannon Mason, Las Vegas, NV (US); Keith Russell, Las Vegas, NV (US); Matt Glazier, Las Vegas, NV (US)

(73) Assignee: IGT, Reno, NV (US)

( * ) Notice: Subject to any disclaimer, the term of this patent is extended or adjusted under 35 U.S.C. 154(b) by 1259 days.

(21) Appl. No.: 10/699,260

(22) Filed: Oct. 31, 2003

(65) Prior Publication Data

US 2004/0142742 A1 Jul. 22, 2004

Related U.S. Application Data

(60) Provisional application No. 60/423,323, filed on Nov. 1, 2002.

(51) Int. Cl.
*A63F 17/00* (2006.01)

(52) U.S. Cl. ..... 463/25

(58) Field of Classification Search ..... 463/16–25, 463/40, 42

See application file for complete search history.

(56) References Cited

U.S. PATENT DOCUMENTS 4,636,951 A 1/1987 Harlick
5,401,023 A 3/1995 Wood
5,639,088 A * 6/1997 Schneider et al. ..... 273/138.2
5,655,961 A 8/1997 Acres et al.
5,741,183 A 4/1998 Acres et al.
5,752,882 A 5/1998 Acres et al.
5,758,875 A 6/1998 Giacalone, Jr.
5,759,102 A 6/1998 Pease et al.
5,766,076 A 6/1998 Pease et al.
5,779,549 A 7/1998 Walker et al.
5,816,918 A 10/1998 Kelly et al.
5,820,459 A 10/1998 Acres et al.

(Continued)

FOREIGN PATENT DOCUMENTS

AU 199954013 4/2000

(Continued)

OTHER PUBLICATIONS

Great Britain Examination Report, dated Jul. 11, 2006, from GB Application No. GB0508826.5.

(Continued)

*Primary Examiner*—Ronald Laneau
(74) *Attorney, Agent, or Firm*—Weaver Austin Villeneuve & Sampson LLP

(57) ABSTRACT

Embodiments of the invention are directed to networked gaming devices that can keep particularized records for identified players. A server can store records of player's present and past actions on the gaming network and can communicate with the gaming device using messaging. In some embodiments, status of games or awards can be stored from one gaming session to another, which allows a player to resume a previously started game or award at a later time. Some games include rewards that are collected over time that can be redeemed for personalized rewards.

11 Claims, 29 Drawing Sheets

U.S. PATENT DOCUMENTS

| | | | | |
|---|---|---|---|---|
| 5,836,817 | A | 11/1998 | Acres et al. | |
| 5,876,284 | A | 3/1999 | Acres | |
| 5,917,725 | A | 6/1999 | Thacher et al. | |
| 5,984,779 | A | 11/1999 | Bridgeman et al. | |
| 6,012,983 | A | 1/2000 | Walker et al. | |
| 6,039,648 | A | 3/2000 | Guinn et al. | |
| 6,068,552 | A | 5/2000 | Walker et al. | |
| 6,110,041 | A | 8/2000 | Walker et al. | |
| 6,135,887 | A | 10/2000 | Pease et al. | |
| 6,142,876 | A | 11/2000 | Cumbers | |
| 6,165,071 | A | 12/2000 | Weiss | |
| 6,183,362 | B1 | 2/2001 | Boushy | |
| 6,219,836 | B1 | 4/2001 | Wells et al. | |
| 6,231,445 | B1 | 5/2001 | Acres | |
| 6,234,896 | B1 | 5/2001 | Walker et al. | |
| 6,238,288 | B1 | 5/2001 | Walker et al. | |
| 6,244,957 | B1 | 6/2001 | Walker et al. | |
| 6,244,958 | B1 | 6/2001 | Acres | |
| 6,254,483 | B1 | 7/2001 | Acres | |
| 6,257,981 | B1 | 7/2001 | Acres et al. | |
| 6,264,560 | B1 | 7/2001 | Goldberg et al. | |
| 6,293,866 | B1 | 9/2001 | Walker et al. | |
| 6,319,125 | B1 | 11/2001 | Acres | |
| 6,350,199 | B1 | 2/2002 | Williams et al. | |
| 6,358,149 | B1 | 3/2002 | Schneider et al. | |
| 6,364,765 | B1 | 4/2002 | Walker et al. | |
| 6,364,768 | B1 | 4/2002 | Acres et al. | |
| 6,371,852 | B1 | 4/2002 | Acres | |
| 6,375,567 | B1 | 4/2002 | Acres | |
| 6,375,569 | B1 | 4/2002 | Acres | |
| 6,379,248 | B1 | 4/2002 | Jorasch et al. | |
| 6,390,917 | B1 | 5/2002 | Walker et al. | |
| 6,422,940 | B1 | 7/2002 | Walker et al. | |
| 6,431,983 | B2 | 8/2002 | Acres | |
| 6,454,648 | B1 | 9/2002 | Kelly et al. | |
| 6,470,828 | B1 | 10/2002 | Paulsen | |
| 6,520,856 | B1 | 2/2003 | Walker et al. | |
| 6,577,733 | B1 | 6/2003 | Charrin | |
| 6,592,457 | B1 | 7/2003 | Frohm et al. | |
| 6,620,046 | B2 | 9/2003 | Rowe | |
| 6,758,757 | B2 | 7/2004 | Luciano et al. | |
| 6,811,486 | B1 | 11/2004 | Luciano, Jr. | |
| 6,923,721 | B2 | 8/2005 | Luciano | |
| 7,033,276 | B2 * | 4/2006 | Walker et al. | 463/40 |
| 7,186,181 | B2 | 3/2007 | Rowe | |
| 7,338,372 | B2 | 3/2008 | Morrow et al. | |
| 7,500,913 | B2 * | 3/2009 | Baerlocher | 463/16 |
| 7,585,223 | B2 * | 9/2009 | Iddings et al. | 463/27 |
| 7,654,856 | B2 * | 2/2010 | Wu | 439/460 |
| 7,674,180 | B2 * | 3/2010 | Graham et al. | 463/29 |
| 2001/0054794 | A1 | 12/2001 | Cole et al. | |
| 2002/0013173 | A1 | 1/2002 | Walker et al. | |
| 2002/0025846 | A1 | 2/2002 | Bennett et al. | |
| 2002/0142825 | A1 | 10/2002 | Lark et al. | |
| 2002/0142846 | A1 | 10/2002 | Paulsen | |
| 2002/0151354 | A1 | 10/2002 | Boesen et al. | |
| 2002/0177480 | A1 | 11/2002 | Rowe | |
| 2002/0187834 | A1 | 12/2002 | Rowe et al. | |
| 2003/0013512 | A1 | 1/2003 | Rowe | |
| 2003/0054881 | A1 | 3/2003 | Hedrick et al. | |
| 2003/0064771 | A1 | 4/2003 | Morrow et al. | |
| 2003/0069071 | A1 * | 4/2003 | Britt et al. | 463/42 |
| 2003/0207711 | A1 | 11/2003 | Rowe | |
| 2004/0077397 | A1 | 4/2004 | Hosaka | |
| 2004/0142742 | A1 * | 7/2004 | Schneider et al. | 463/25 |
| 2004/0185936 | A1 * | 9/2004 | Block et al. | 463/42 |
| 2005/0014554 | A1 * | 1/2005 | Walker et al. | 463/20 |
| 2007/0117616 | A1 * | 5/2007 | Bartholomew | 463/29 |

FOREIGN PATENT DOCUMENTS

| | | | |
|---|---|---|---|
| AU | 2002258628 | | 10/2002 |
| DE | 43 39 792 | A1 | 5/1995 |
| DE | 4339792 | A1 | 5/1995 |
| EP | 1318863 | A1 | 3/2002 |
| GB | 2 397 403 | A | 7/2001 |
| GB | 2397403 | | 7/2004 |
| JP | 2001-325455 | | 11/2001 |
| WO | WO 00/12186 | | 3/2000 |
| WO | WO 02/22222 | A1 | 3/2002 |
| WO | WO 03/015042 | A1 | 2/2003 |

OTHER PUBLICATIONS

Great Britain Examination Report, dated Apr. 23, 2007, from GB Application No. GB0706321.7.

Great Britain Examination Report, dated Jul. 19, 2005, from GB Application No. GB0508826.5.

Great Britain Examination Report, dated Feb. 9, 2006, from GB Application No. GB508826.5.

Great Britain Examination Report, dated Dec. 8, 2006, from GB Application No. GB508826.5.

Great Britain Examination Report, dated Apr. 24, 2007, from GB Application No. GB508826.5.

International Search Report mailed Jun. 4, 2004 PCT WO 2005/0304053.

AU Examination Report, dated May 19, 2006, from AU 200304472.

Canadian Office Action, from CA Application No. 2,504,699 dated Aug. 14, 2008.

Canadian Office Action, dated Jul. 17, 2009 from CA Application No. 2,504,699.

Chinese Office Action dated Jul. 17, 2009 from Application No. 2004800265558.

PCT International Preliminary Examination Report dated Mar. 16, 2006 issued in W02005029814.

U.S. Advisory Action dated Jan. 27, 2009 from U.S. Appl. No. 10/247,786.

U.S. Advisory Action dated Mar. 13, 2007 from U.S. Appl. No. 10/247,786.

U.S. Advisory Action dated May 12, 2009 from U.S. Appl. No. 10/942,208.

U.S. Advisory Actions dated Mar. 28, 2008 from U.S. Appl. No. 10/942,208.

*Brandstetter et al.* v. *Bally Gaming Inc. et al.*, Case No. A571641, Compliant filed Sep. 15, 2008.

*Brandstetter et al.* v. *Bally Gaming Inc. et al.*, Case No. A571641, Defendants IGT et al's. Answer to Compliant, filed Oct. 15, 2008.

*Brandstetter et al.* v. *Bally Gaming Inc. et al.* Case No. A571641, Defendants Bally Gaming, Inc's Motion To Dismiss; Motion For More Definite Statement, filed Nov. 17, 2008.

*Brandstetter et al.* v. *Bally Gaming Inc. et al.*, Case No. A-571641C, Opposition To Bally Gaming, Inc.'s Motion To Dismiss; Motion For More Definite Statement, filed Nov. 25, 2008.

*Brandstetter et al.* v. *Bally Gaming Inc. et al.*, Case No. A571641, Opposition To Scott Boyd's Motion To Dismiss, filed Dec. 10, 2008.

*Brandstetter et al.* v. *Bally Gaming Inc. et al.*, Case No. A571641, Affidavit Of Michael Longmeyer, filed Dec. 11, 2008.

*Brandstetter et al.* v. *Bally Gaming Inc. et al.*, Case No. A571641, Defendants IGT and Acres Gaming, Inc.'s Motion For Summary Judgment, filed Dec. 12, 2008.

*Brandstetter et al.* v. *Bally Gaming Inc. et al.*, Case No. A571641, Affidavit of Scott Boyd, filed Dec. 12, 2008.

*Brandstetter et al.* v. *Bally Gaming Inc. et al.*, Case No. A571641, Bally Gaming, Inc.'s Reply In Support of Motion To Dismiss and for More Definite Statement, filed Dec. 23, 2008.

*Brandstetter et al.* v. *Bally Gaming Inc. et al.*, Case No. A571641, Errata To Motion for Summary Judgment, filed Jan. 8, 2009.

*Brandstetter et al.* v. *Bally Gaming Inc. et al.*, Case No. A571641, Opposition to Defendants' IGT and Acres Gaming, Inc.'s Motion For Summary Judgment, filed Jan. 9, 2009.

*Brandstetter et al.* v. *Bally Gaming Inc. et al.*, Case No. A571641, Reply To Plaintiffs' Opposition To Defendants IGT and Acres Gaming, Inc.'s Motion For Summary Judgment, filed Jan. 13, 2009.
*Brandstetter et al.* v. *Bally Gaming Inc. et al.*, Case No. A571641, Supplemental Exhibit J to Reply To Plaintiffs' Opposition To Defendants IGT and Acres Gaming, Inc.'s Motion For Summary Judgment, filed Jan. 14, 2009.
*Brandstetter et al.* v. *Bally Gaming Inc. et al.*, Case No. A571641, First Amended Complaint With Exhibit "A" filed Under Seal Pursuant To Court Order, filed Jan. 30, 2009.
*Brandstetter et al.* v. *Bally Gaming Inc. et al.*, Case No. A571641, Defendant Bally's NRCP 16.1 Early Case Conference Report, dated Feb. 27, 2009.
*Brandstetter et al.* v. *Bally Gaming Inc. et al.*, Case No. A571641, Defendants' Case Conference Report, dated Mar. 30, 2009.
*Brandstetter et al.* v. *Bally Gaming Inc. et al.*, Case No. A571641, Findings Of Fact, Conclusions of Law & Judgment, filed Jun. 11, 2009.
Australian Examination Report, dated Jul. 31, 2007 from Application No. 2002327664.
British Examination Report dated Oct. 8, 2004 from Application No. GB308224.5.
British Examination Report dated Jun. 17, 2005 from Application No. GB0308224.5.
British Examination Report dated Aug. 24, 2005 from Application No. GB0308224.5.
British Examination Decision dated May 3, 2006 from Application No. GB0308224.5.
British Examination Report dated Nov. 15, 2005 Application No. GB0308224.5.
British Examination Report dated Nov. 15, 2005 from Application No. GB 0051367.5.
British Examination Report dated Jun. 2, 2006 from Application No. GB 0051367.5.
British Examination Report dated Jun. 30, 2005 from Application No. GB 0051367.5.
British Examination Report dated Jan. 24, 2006 from Application No. GB 0051367.5.
Canadian Office Action dated Jun. 27, 2005 from Application No. 2,428,028.
Canadian Office Action dated Jun. 28, 2006 from Application No. 2,428,028.
Canadian Office Action dated Nov. 14, 2007 from Application No. 2,428,028.
Canadian Office Action dated Jan. 27, 2009 from Application No. 2,428,028.
International Search Report dated Mar. 17, 2003 from Application No. PCT/US02/29805.
Chinese Office Action dated Dec. 5, 2008, from Application No. 2004800265558.
European Office Action dated Sep. 7, 2006 from Application No. 04788767.4.
International Search Report and Written Opinion of the International Searching Authority dated Sep. 15, 2003, for corresponding PCT Application No. PCT/US2004/030198.
U.S. Office Action dated Apr. 27, 2009 from U.S. Appl. No. 10/247,786.
U.S. Office Action dated Oct. 14, 2008 from U.S. Appl. No. 10/247,786.
U.S. Office Action dated Apr. 2, 2008 from U.S. Appl. No. 10/247,786.
U.S. Office Action dated Nov. 16, 2007 from U.S. Appl. No. 10/247,786.
U.S. Office Action dated Jun. 19, 2007 from U.S. Appl. No. 10/247,786.
U.S. Office Action dated Nov. 13, 2006 from U.S. Appl. No. 10/247,786.
U.S. Office Action dated Dec. 30, 2005 from U.S. Appl. No. 10/247,786.
U.S. Office Action dated Jan. 26, 2009 from U.S. Appl. No. 10/942,208.
U.S. Office Action dated Jul. 11, 2008 from U.S. Appl. No. 10/942,208.
U.S. Office Action dated Jan. 7, 2008 from U.S. Appl. No. 10/942,208.
U.S. Office Action dated Jul. 6, 2007 from U.S. Appl. No. 10/942,208.
U.S. Office Action dated Nov. 20, 2009 issued in U.S. Appl. No. 10/942,208 (Russell et al).
*Brandstetter et al.* v. *Bally Gaming Inc. et al.*, Case No. A571641, Compliant filed Sep. 15, 2008.
*Brandstetter et al.* v. *Bally Gaming Inc. et al.*, Case No. A571641, Defendants IGT et al's. Answer to Compliant, filed Oct. 15, 2008.
LeMay et al. (2000) U.S. Appl. No. 09/642,192 (unpublished, abandoned) entitled: "Gaming Machine Virtual Player Tracking and Related services," filed by inventor, Steven G. LeMay on Aug. 18, 2000 (35 pages).
Australian Examination Report dated Sep. 1, 2009, issued in AU2004305823.

* cited by examiner

PLAYER SPECIFIC REWARDS

CROSS-REFERENCE TO RELATEDAPPLICATIONS

This application claims priority from U.S. provisional application 60/423,323, entitled Player Specific Rewards, filed on Nov. 1, 2002, the contents of which are expressly incorporated herein by reference.

TECHNICAL FIELD

This disclosure relates to gaming, and, more particularly, to a system where networked games can be played over multiple sessions.

BACKGROUND

Because there are many choices of casinos from which a patron can choose, casinos are constantly searching for ways to differentiate themselves. One such method is by developing new games and gaming environments that encourage players to return. Loyalty programs are well known; where players earn an award for playing gaming devices with the amount of the award determined by the amount of coins deposited into the game, game outcome, certain bonuses or extra awards won, or other various factors. Typically, the awards accumulate in an account, similar to frequent flyer miles, until used by the patron. By returning to the same casino, or same group of casinos, the award account can accumulate to a valuable amount.

Although loyalty programs are successful in encouraging patrons to return, patrons are always seeking new, unique, and interesting ways to be entertained and to get a maximum benefit from their entertainment dollar.

Embodiments of the invention address this need.

SUMMARY

In one aspect, the invention features a gaming network comprising a player processing system and a gaming device coupled to the player processing system. The player processing system is structured to record data about a player. The gaming device is structured to configure a present state of an award based on the recorded data.

In another aspect, the invention features a gaming network comprising a gaming device, player tracking hardware, a player tracking system, and a player specific gaming server. The gaming device has a primary game and a bonus game. The player tracking hardware is coupled to the gaming device and is structured to identify a player of the gaming device. The player tracking system is also coupled to the gaming device and is structured to store data about gameplay of the player of the gaming device. The player specific gaming server is coupled to the player tracking system and to the gaming device. The gaming server is structured to record session information of the bonus game played on the gaming device by the player.

BRIEF DESCRIPTION OF THE DRAWINGS

FIGS. 14-22 are example screen shots showing a cash draw ticket type reward.

DETAILED DESCRIPTION

A player specific game system (PSGS) allows a casino to track a player's game playing (and other) activity and adjust game characteristics to meet a player's tastes, playing habits, budget, and to keep a their interest. Loyalty awards can be specifically tailored to directly impact the player's game play. Benefits to the casino include a more direct communication platform through which loyalty building promotional information can be delivered to a customer. Additionally, the casino is able to rapidly change loyalty promotions, which builds player excitement and keeps players interested in returning to the particular casino.

Figure 1:
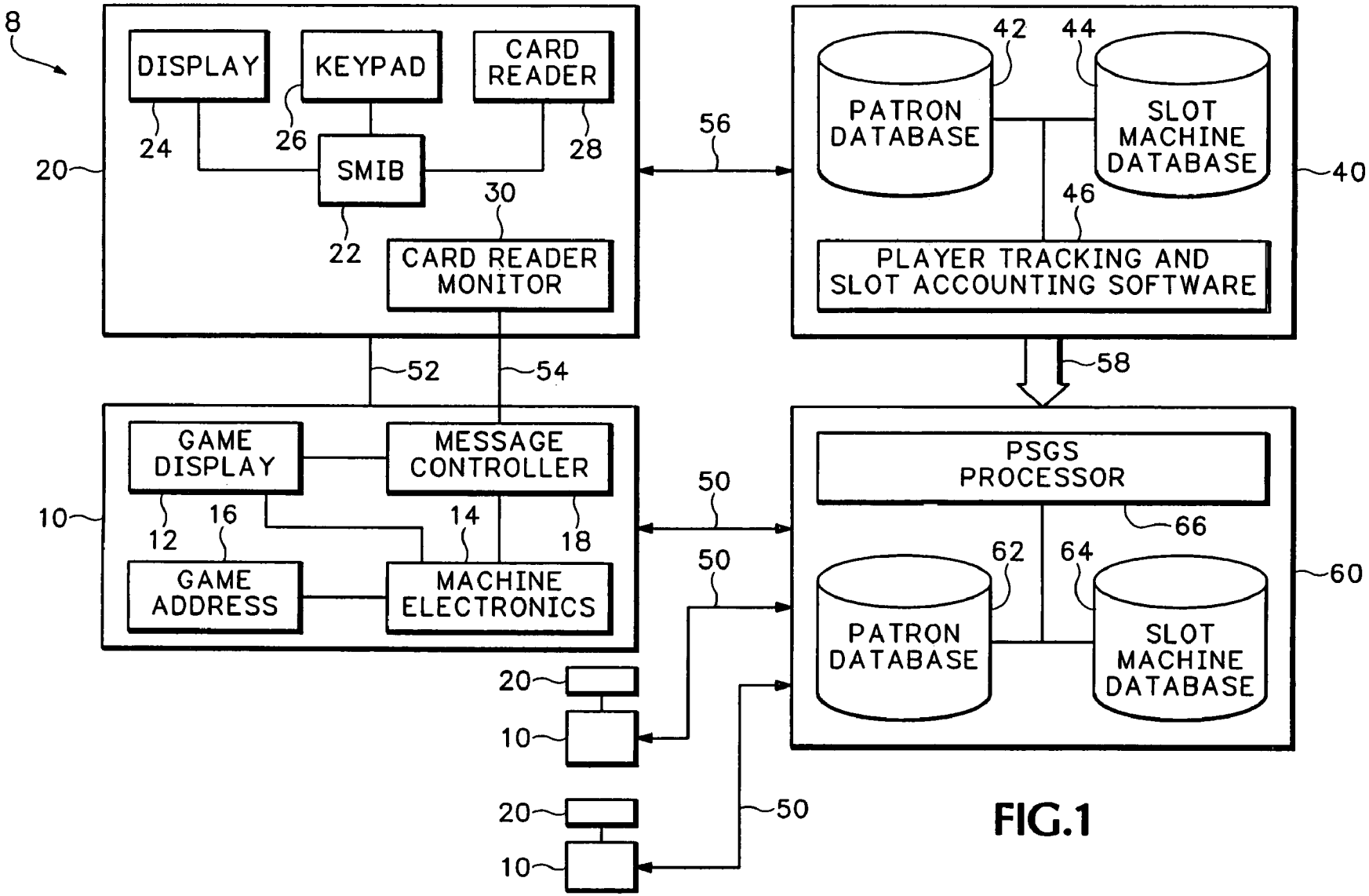
FIG. 1 is a block diagram illustrating components of the PSGS system according to an embodiment of the invention.

FIG. 1 illustrates an example PSGS system 8 according to embodiments of the invention. The PSGS system, generally, includes a customizable electronic gaming machine 10 (EGM), a set of player tracking hardware 20, a player tracking system 40, and a PSGS server 60. Each of the components can communicate with one another over communication interfaces. For example, the PSGS server 60 communicates to the EGM 10 over a PSGS network 50, which can be a wired or wireless network, or a combination of both. The EGM 10 communicates to the player tracking hardware 20 over a communication link 52, which is well known to those skilled in the art. For example, descriptions of the link 52 and the interaction between an EGM 10 and a player tracking system 20 are included in U.S. Pat. No. 5,655,961 and U.S. Pat. No. 6,319,125, assigned to the assignee of the present invention. A card reader monitor component 30 of the player tracking hardware 20 can communicate directly with machine electronics 14 of the EGM 10 through a separate communication link 54. The player tracking hardware 20 communicates with the player tracking system 40 over a communication link 56, also known as a casino system network. Casino networks are well known in the industry and are detailed in the '961 patent referenced above. The player tracking system 40 communicates to the PSGS server 60 through one or more gateways, illustrated here as a communication link 58. Detailed discussion of the types of communication between all of the components in the PSGS system 8 follows.

Although only one detailed EGM 10 is illustrated in FIG. 1, multiple EGMs 10 can be connected to the PSGS server 60 over a separate or shared communication link 52. Each of the EGMs 10 has an accompanying set of player tracking hardware 20, which also connects to the player tracking system 40 through a casino system network link 56, although these links have been omitted in FIG. 1 for clarity.

Within the PSGS server 60 are a patron database 62 and a slot machine database 64, the contents of which are described below. The PSGS server 60 may be embodied by a single or multi-processor computer having 1-4 CPUs, for example. Intel PENTIUM or AMD 32 or 64 bit processors operating at 2 Ghz or faster could drive the server 60. The operating system could be a MS Windows, BSD, or Linux based system, for example Redhat Advanced server. The database could be Oracle, SQL Server, MySQL, or PostgreSQL and connected by JDBC (Java DataBase Connectivity), for instance. Additionally, the PSGS server 60 can host a web server, such as an Apache server, and an application server such as Tomcat or JBoss, which are well known in the industry. Security on the PSGS network 50 uses SSL (Secure Socket Server). A communication protocol for use between the PSGS server 60 and the EGM 10 could be XML-RPC Communication protocol, for instance.

The EGMs 10 may be powered by a less powerful processor than the PSGS server, such as a single Intel Celeron or Pentium processor. In one embodiment, the EGMs 10 operate using a customized kernel for the Linux Operating System.

The EGM 10 may communicate to the Player Specific Game Server 60 over the PSGS network 50 using an Ethernet port. The protocol used could be TCP/IP. Upon initialization, the EGM 10 will configure the network adapter utilizing an address obtained for the particular machine. A game address block 16 may include an address, for example a TCP/IP address burned into an EPROM that is coupled to a set of machine electronics 14. When initialized, the machine electronics reads the previously burned address as the address to use for itself on bootup. Providing a previously burned and relatively hard coded address provides security from an EGM being hacked by unauthorized personnel. Instead of an EPROM, a hardware dongle could also provide address information.

The identity EPROM, or equivalent, may contain information such as a resort ID, a casino ID, a machine serial number, the IP address for the machine, an IP subnet mask, a machine broadcast address, a machine gateway address, and an application Server URL.

When the EGM 10 initializes, it sends the information from the identity EPROM to the PSGS server 60, where the particular EGM 10 can be authorized as eligible to connect to the PSGS system 8.

Providing an identity EPROM has advantages in that it provides a mechanism of providing a unique ID for the machine that is independent from the EGM 10, it provides a measure of security because the data is in binary format and not easily read or modified without the proper tools, and the structure is easy to setup in the field.

The EGMs 10 also include increased security measures that ensure only authorized personnel access the machines. For instance, only authorized personnel with appropriate levels of access (and keys) are able to obtain entry to the internals of the EGM 10. All door opens and closures are recorded. Personnel must possess and be authorized to create the identity EPROM, and further, the EPROM must pass version/hash comparison testing.

Once initiated, a technician will be able to verify the TCP/IP address that is read from the game address block 16 by reading the address on the game display 12. The IP address will only be shown on the game display 12 during installation or servicing modes, and will not be available to the general public.

Multi-Session Gaming

In embodiments of the invention, a game is presented that can be played by players that identify themselves to the game owner, such as a casino, and by players who are unknown to the casino. Identified players are known as "carded" players because they identify themselves by placing an identification card into a card reader 28 (FIG. 1) in the player tracking hardware 20. Unknown players, i.e., those who do not insert an identity card, are known as "uncarded" players.

In a game according to embodiments of the invention, certain features are available to carded players that are not available to uncarded players. These special game features may be advertised to uncarded players to give them an extra incentive to join the loyalty program in the casino where the game is located.

In a particular embodiment, a game according to embodiments of the invention includes a base game, which could be a video slot machine for instance. The base game may be played by carded and uncarded players alike. The game can include one or more bonuses. Some of the bonuses are available to carded and uncarded players, while other bonuses are available only to carded players. In one particular bonus, available only to carded players, the players take a simulated "journey" along a path beginning at a first location (initial state) and ending at a known destination (non-initial state). An indicator of where the player is on the journey advances along a displayed route, so the player knows where he or she is in the journey. A player advances to another point (non-initial state) on the journey when events occur. For instance, in a simple embodiment, the journey may begin after the carded player has played for "x" minutes, or has played "y" number of games, or has played "z" amount of value in the game. The last determination, amount of value played in the game, is known as "coin-in", and is a measure of how much money the patron has spent on the game, no matter how long it took the patron to do so. Using coin-in is a convenient way to measure patron activity. For example, the journey may include 10 stopping points and the player advances to the next stopping point after the player has the minimum amount of coin-in since the previous stopping point. In a more advanced embodiment, the triggering event that causes a player to advance from one stopping point to another can be a random or pseudo random event.

To complete a reward journey, a player may have to spend a relatively long time at the game. Using embodiments of the invention, a player may split portions of the reward journey into multiple "sessions" of play. For instance, the player may initially play the game for 45 minutes and may advance to the second of ten stops on the reward journey. In embodiments of the invention, because the player is a carded player, the PSGS server 60 may record and "store" the player's progress. Thus, when the player returns and re-identifies himnself or herself by inserting his or her player identification card into the game, the game returns to its previously stored state where the player had already advanced to the second (non-initial state) of ten stops in the reward journey. When the player then plays the game enough to advance to the next stopping point, the game automatically advances to the third stopping point, rather than beginning again at the first (initial state). In this way, the entire reward journey can be played over multiple gaming sessions, which encourages players to return to the same casino.

In another embodiment of the invention, the player may be able to continue the reward journey on machines in more than one casino, provided the casinos are related. Under this scenario, a resort group might have a Player's Club that spans multiple properties and would want to encourage return play to any property within that group.

In another embodiment of the invention, as players move from one stop to another in the journey, they may acquire a token that is randomly selected from a group of possible tokens. At the end of the journey, the tokens are "redeemed", and the number of different tokens the player has collected along the journey determines a final reward to the player for completing the journey. Higher rewards can be awarded for higher numbers of unique tokens gathered on the journey, with the highest reward being awarded to the player who gathers a unique token for each stop on the journey.

Game Screen

Figure 2:
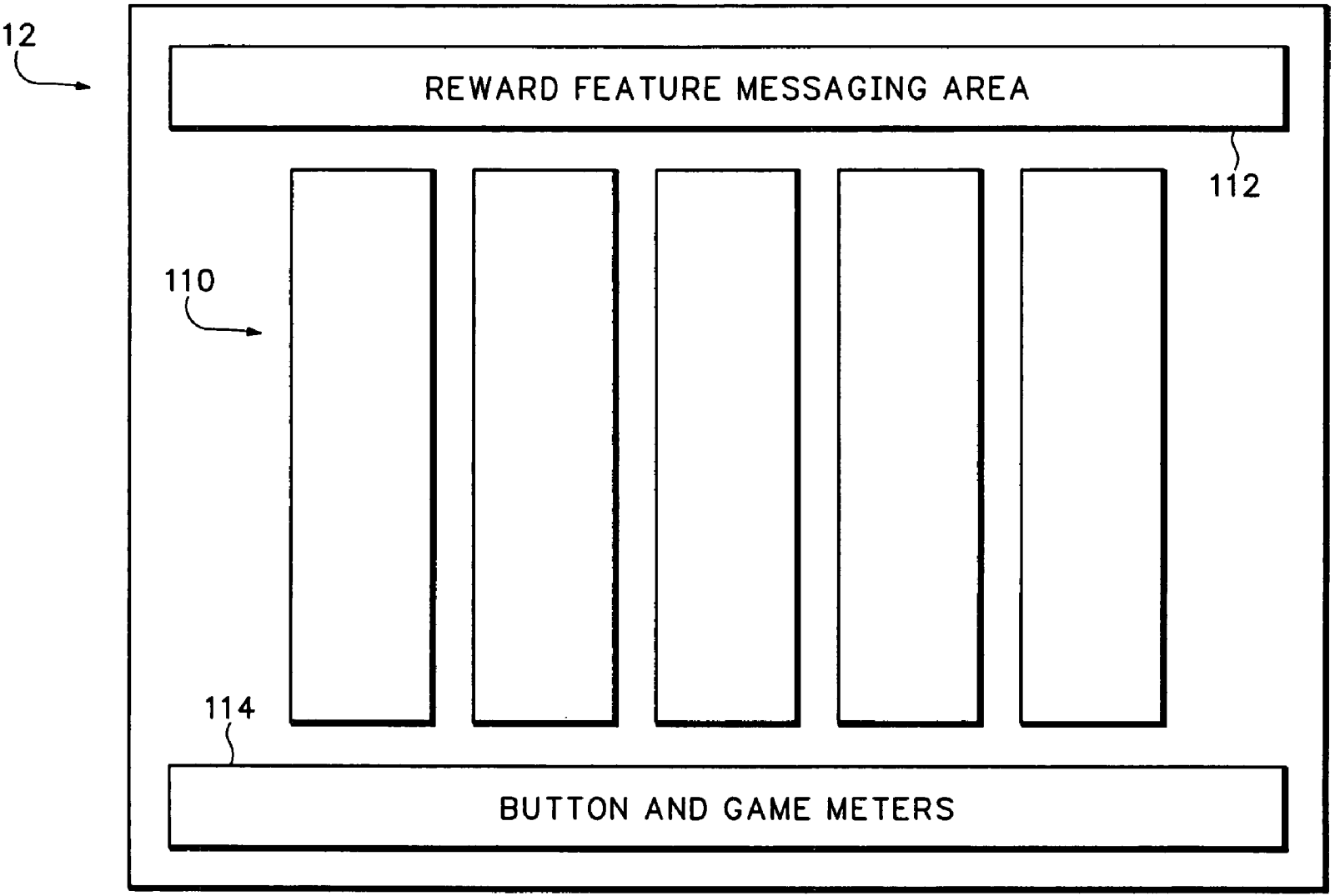
FIG. 2 is a block diagram illustrating divisions on a game screen according to embodiments of the invention.
Figure 3:
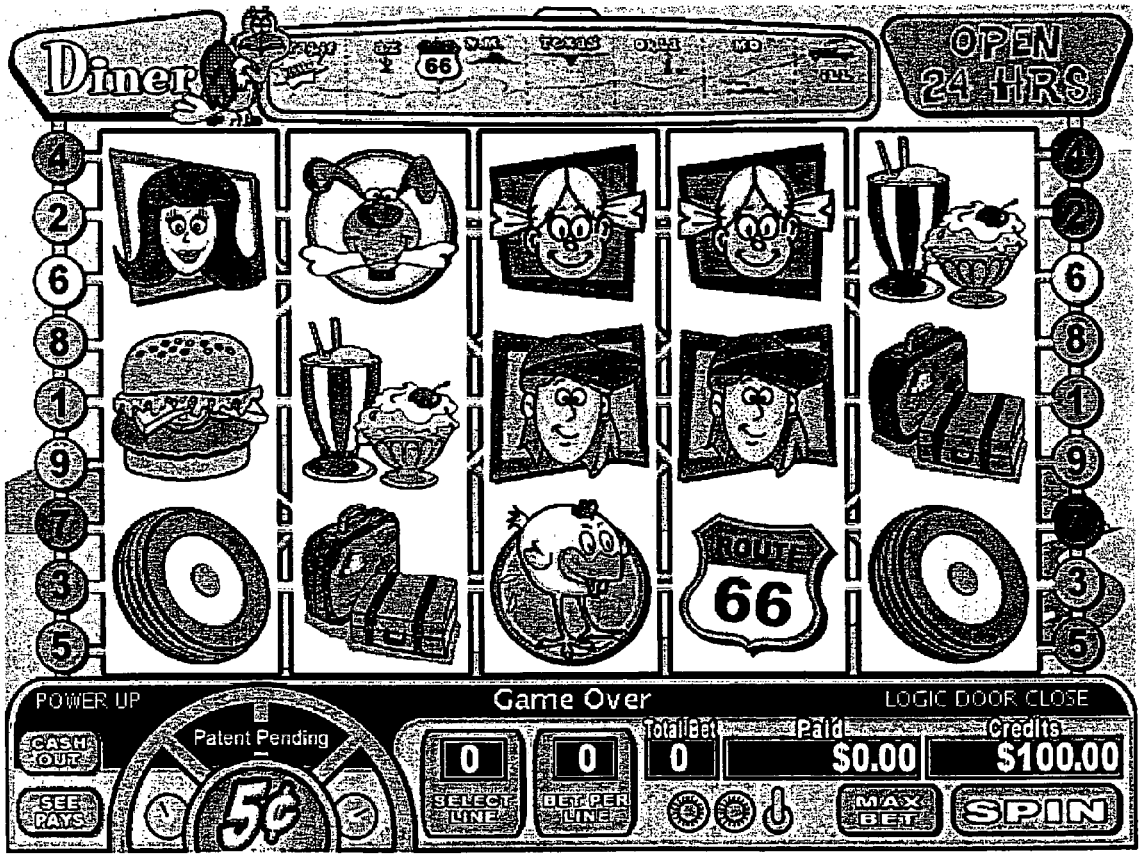
FIG. 3 is a screen shot illustrating an example game screen with a Player's card inserted.
Figure 4:
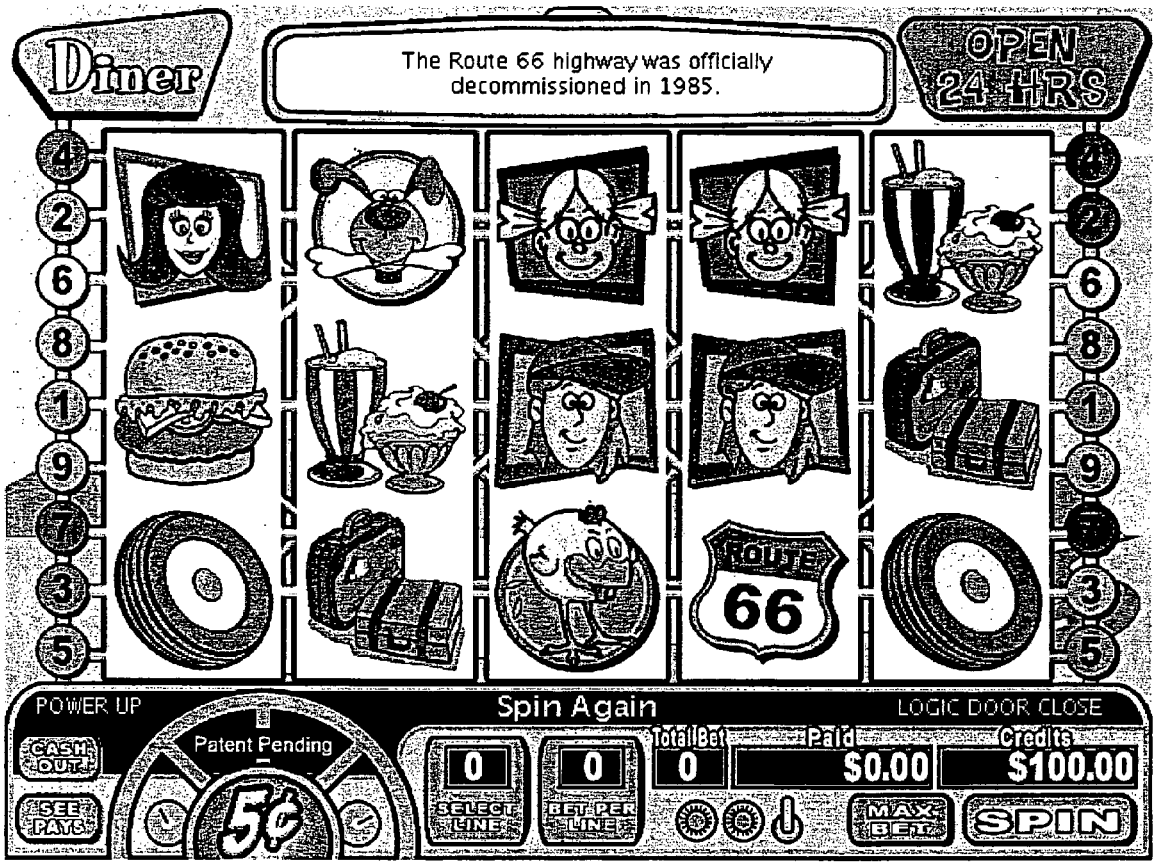
FIG. 4 is a screen shot illustrating an example game screen with a Player's card removed.

FIG. 2 illustrates in block form a sample game screen that can be used in embodiments of the invention, and FIGS. 3 and 4 illustrate an illustrated sample screen. Almost any conceivable type of game can be used to embody elements of the invention, but for purposes of illustration a video slot machine will be described. The primary game is a 5 or 9-line, 5 reel video slot machine. A 9-line video slot is illustrated in FIG. 3. Typically, the game would have a second screen reward feature that could be won by carded and non-carded players alike. The second reward screen feature could be funded i.e., rewards paid out of, a pool accumulated by an overall payback percentage of the machine, or another reward pool funding mechanism could be employed. In some embodiments, the reward pool operates similar to a personal progressive reward as described below. Personal progressive awards are well known to those skilled in the art.

Referring back to FIGS. 1 and 2, a game screen 12 is divided into a central area 110, where the main game is shown, a reward feature messaging area 112, and a button and game meter area 114. In this embodiment, the central area 110 is divided into five discrete areas for video reels.

The reward messaging area 112 is can include messages informing the patron of reward features, status in the reward feature, help screens, pay table screens, and other miscellaneous details to help explain or entertain the patron. As illustrated in FIG. 3, the reward messaging area 112 includes a simulated "map" of Route 66, from Illinois to California, while the same area in FIG. 4 shows an informative message to the player. Graphics to be displayed in the messaging area 112 can be stored within the EGM 10 itself, or within the PSGS server 60, for instance. If the graphics are stored on the EGM 10, the PSGS server 60 can direct the EGM when to display particular graphics. Communication protocols between the PSGS server 60 and the EGM 10 are discussed in detail below.

When the game on the EGM 10 is initialized, an initial view is illustrated on the display 12. Messages and graphics can be shown informing the player that certain benefits are available to a carded player that are not available to an uncarded player. In addition, the initialization screen may allow a non-carded player to view a details screen, described below, as well as the pay table for the reward feature.

When a player inserts his or her card, a message in the reward feature messaging area 112 can welcome the player by name and can communicate the player's status in the reward feature, such as by generating a map indication the player's current position on the "journey".

If a non-carded player is playing the game on the EGM 10, the reward messaging area 112 can illustrate enticing messages that invite the non-carded player to register to become a carded player.

While a carded player is playing, the reward messaging area 112 can show different types of screens, such as indicating to the player their present position in the reward journey, a list of tokens the player has already collected, and an amount of money that the player could win by completing the reward journey.

Downloadable Pay Tables

Because of the interaction and communication between the PSGS server 60 and the EGM 10, it is possible to control or modify some components of game that previously were uncontrollable. Specifically, the machine pay tables themselves can be stored on the PSGS server 60, for example on the slot machine database 64, and be downloaded into the EGM 10 as part of the game initialization, or after the game is initialized. In operation, downloading paytables could be implemented by using the messaging system described below.

Pay tables relate the outcome of a game played to the benefit received by the player for the particular game outcome. EGMs 10 typically include a standard pay table for a game, i.e., the pay table that is the standard pay table offerings for that game. In addition, one or more (or all) of the elements within the pay table can be changed by downloading new data from the PSGS server 60 into the EGM 10.

Game tables can be changed for a number of reasons. For instance they can be changed for different times of the day. Also, they can be changed for specific promotions. The machine pay tables can also be changed for individual players or groups of players. For instance, a first set of game pay tables can be created for a player with no detail history stored in the player tracking system 40. Then, as more is learned about the player's style, habits, preferences, skill level, etc., for example, the game tables can be modified by running a process on the PSGS server 60. Once modified, the PSGS server 60 can cause the modified pay table to be downloaded to the game for the player. In one embodiment, when a player identifies himself or herself by inserting a player tracking card, the PSGS server 60 retrieves the personalized machine pay table and downloads it to the EGM 10 at which the player is playing. Then, the EGM 10 changes its current pay table to the one just loaded by the PSGS server 60, such that the gaming table is personalized for that player.

As one can imagine, countless variations in modifying machine tables are possible. The PSGS server 60 may modify machine paytables at games to which it is connected every hour. Therefore, a particular machine outcome at 5:00 am may be different from one at 11:00 pm. Additionally, if a player known to the PSGS server 60 is playing a machine at 5:00 am, the PSGS could be programmed to either override the standard "modified" pay table, or to load the pay table that has been "created" for that particular player. It is also possible to change the paytable to the player specific pay table at some times and not at others. Even further, it is possible to have modified pay tables for each individual EGM 10. For instance, pay tables can be modified for games at a first casino, but not at a second casino. Or, pay tables can be modified for a particular game at a casino based on the game's physical location. In short, the PSGS system 8 control of modified game tables can extend down to the level of a different pay table for a player for each and every single game to which the PSGS system is connected. However, there may be too much overhead in keeping so many modified pay tables for each of the players, and keeping modified pay tables per game type for particular players may be an acceptable level of control/service for the overhead involved.

Messaging to the Player

As the player plays the game on the EGM 10, the existing player tracking system 40 records details about the player, as well as stores historical records on the player's past play, and other details about the player. The PSGS system 60 is able to use past and present data about the player to provide individualized messages to the player through the display 12 of the EGM, or, in other embodiments, though a display 24 on the player tracking hardware 20 (FIG. 1).

The player is identified to the EGM 10 through the player tracking hardware 20, illustrated in FIG. 1. The player tracking hardware 20 can include a Serial Machine Interface Board (SMIB) 22, a display 24, which can be a touch-screen display, a keypad 26, and a card reader 28. Additionally the player tracking hardware 20 can include a card reader monitor 30 that monitors events of the player tracking hardware, as described below.

Figure 5:
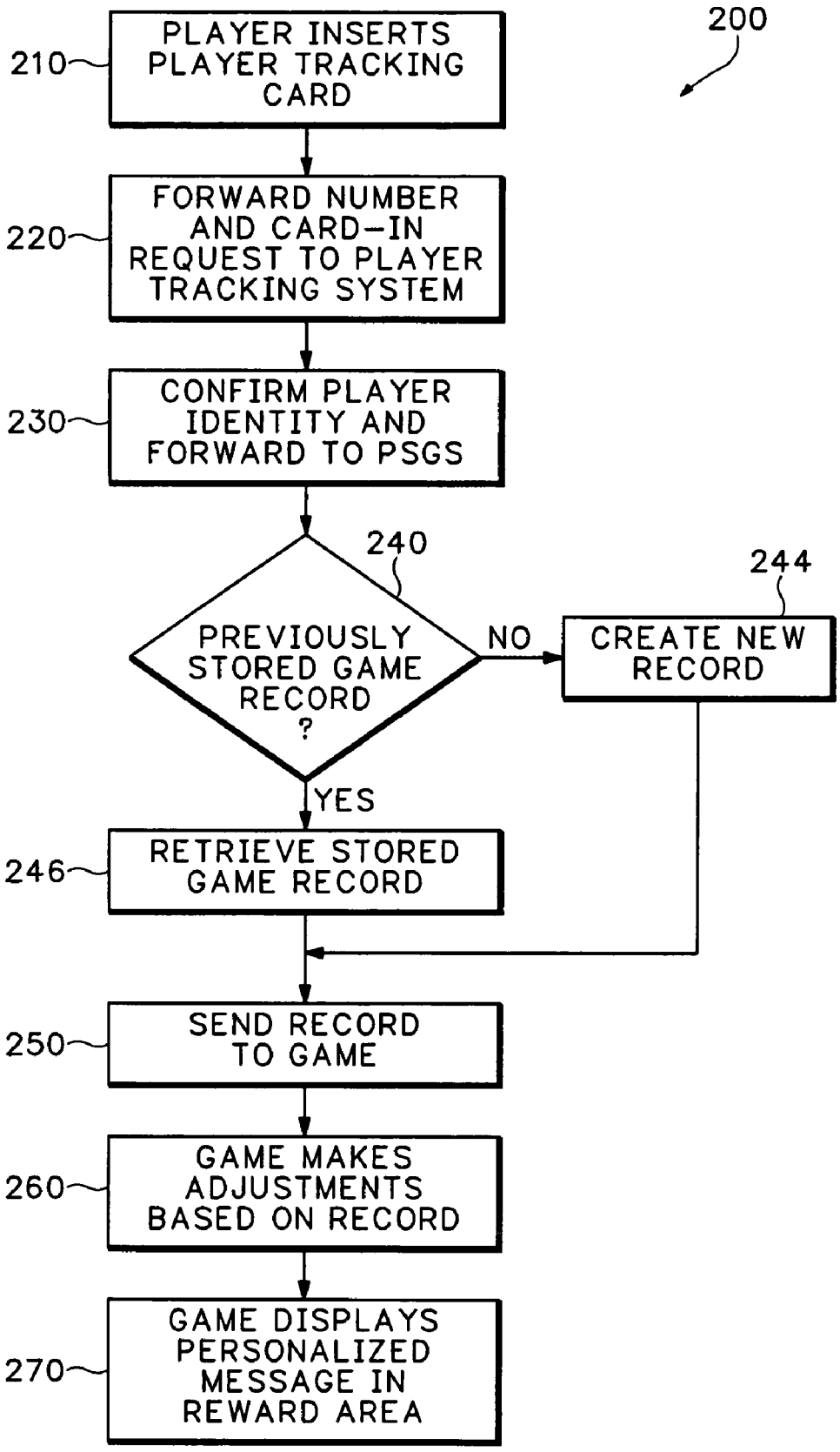
FIG. 5 is an example flow diagram illustrating communication between components of the PSGS system according to embodiments of the invention.
Figure 6:
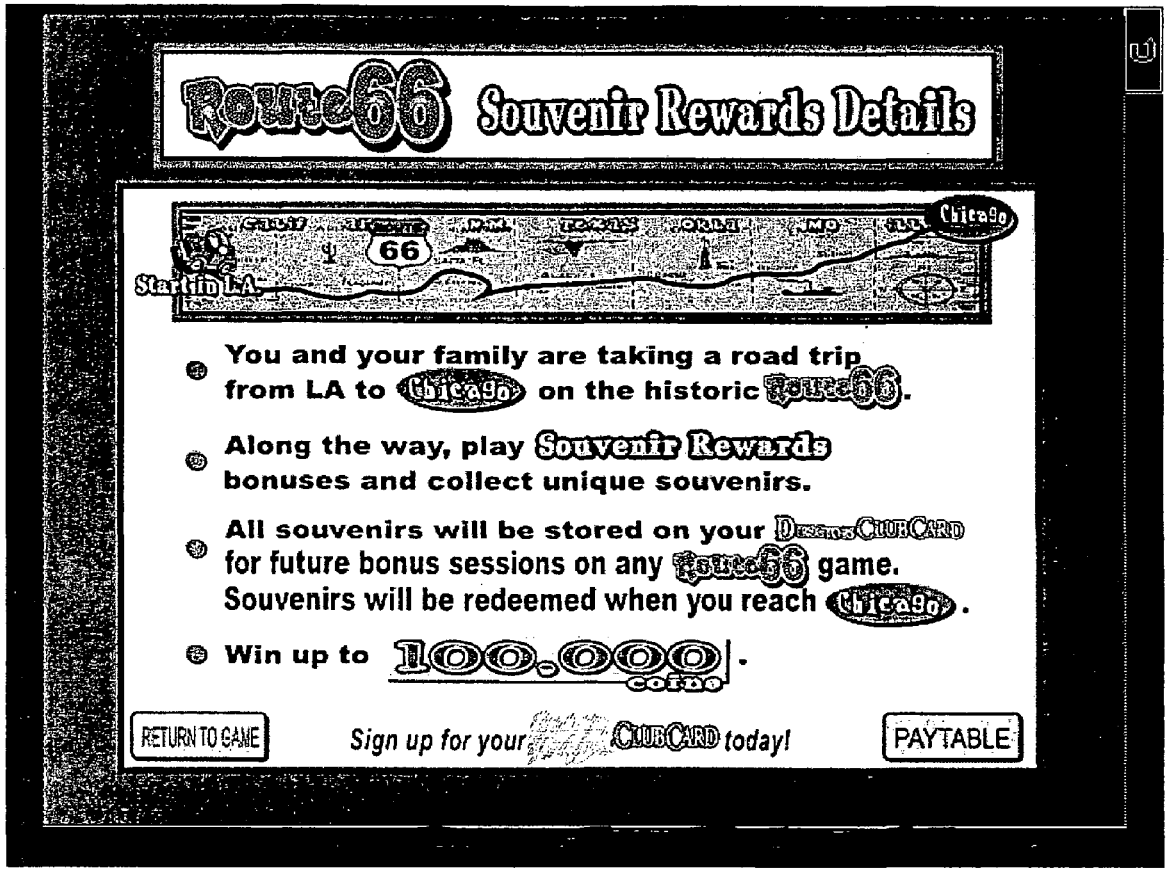
FIGS. 6-13 are example screen shots showing a collection type reward.

FIG. 5 is an example flow diagram illustrating general processes that can be used in embodiments of the invention and illustrates the communication between different components of the PSGS system 8 of FIG. 1.

A flow 200 begins at a process 210 when a player inserts their player tracking card into the card reader 28 of the player tracking hardware 20. The card reader monitor 30 reads data from the card and can perform a low-level check on the card before sending the data from the card to the player tracking system 40, along with a "card-in" request, in a process 220.

The player tracking system 40 authenticates the player by verifying the information against data stored on a patron database 42 and/or a slot machine database 44 in a process 230. This information is then sent to the PSGS server 60. In a process 240, the PSGS server 60 determines if the particular identified player has a previously stored game record, i.e., that the player had already began a reward journey in a previous game session. If not, a new game record is created in a process 244. If the player had a previous game session, the record is retrieved in a process 246. Then, either the newly created or the retrieved record is sent to the EGM 10 in a process 250.

Once the record is sent to the EGM 10, the game makes adjustments based on the record in a process 260. For example, if the player had already progressed to the third of ten stops in the reward journey, then the EGM 10 would change to a state where the third stop had already been reached. Next, the EGM 10 displays a personalized message in the reward area 112 of the gamescreen 12, which informs the player that he or she has been recognized by the system, and that credit for previous play has been acknowledged and accredited by the EGM 10.

The following provides more details of messaging and message interaction between the between card reader monitor 30 (CRM 30), the message controller 18 (MC 18), the EGM 10 and the PSGS server 60 according to embodiments of the invention.

The MC 18 is the "traffic cop" for messaging within the PSGS system 8 of FIG. 1. The MC 18 can be embodied by a process that runs on the EGM 10, but is separate from the game itself. Typically, the MC 18 would be started before a game running on the EGM is started, and would be running prior to the player tracking hardware 20 being initialized. The MC 18 could be a software process that is initialized using an AGPx start-up process. In the event the MC 18 terminates abnormally, it automatically restarts and reestablishes communications to the various components to which it is connected.

In operation, the MC 18 receives and disperses messages to and from authorized and intended processes, such as a game operating on the EGM 10, the card reader monitor 30, and the PSGS server 60. When the MC 18 initializes, it registers itself with the PSGS server. In some embodiments, the MC 18 communicates to the PSGS server over the PSGS network 50 using XML based messaging.

The MC 18 can maintain a "heart beat" between itself and the PSGS server 60, between itself and the game operating on the EGM 10, and between itself and the card reader monitor 30.

Typically, the MC 18 functions in two modes: a first when all necessary processes are present, and a second in which one of the necessary processes is missing, as determined by the heart beat. When one of the processes is missing, the MC 18 can still operate, such as when various components are being simulated. This could be beneficial during testing, for instance.

Messages between the MC 18 and the game operating on the EGM 10, and between the PSGS server 60 can be of any acceptable format. One example format uses serialized messages using RMI (Remote Method Invocation), which is a closed message format/protocol not used by any other types of gaming device or gaming network. Having a private message protocol protects the integrity of the gaming system and prevents intrusion from outside, non-authorized users. The MC 18 can also include an open messaging format, which allows the MC 18 to interface with standard gaming devices. The open messaging format may use standards such as XML and the protocol such as XML-RPC, which can be utilized by systems developed in the Java language, and in systems developed in languages other than Java. The messages can be encrypted utilizing SSL, which will ensure the messages cannot be intercepted.

The MC 18 may cache a limited number of messages at the local level, i.e., within the process itself that runs on the EGM 10. Caching larger amounts of messages may cause problems, for instance if the player were to hit numerous bonus events and/or reward redemptions during a communications failure between the MC 18 and the other components. Under that scenario, a player could in fact redeem his/her winnings then move to another machine and resume play. If communications were down, the PSGS system 8 would be unaware that the player had already redeemed the awards and could possibly resume play at the point where communications had failed. Therefore, the possibility would exist that the player redeems the rewards twice. To prevent against this possibility, only a very limited number of messages are can go unacknowledged by the PSGS server 60 before PSGS functionality is disabled.

For example, if the PSGS server 60 does not respond before the aforementioned message limit is reached, another message will be sent to the EGM 10 which causes the PSGS functionality to be disabled due to server non-availability. In case of a power failure on the EGM 10, the MC 18 should be able to retain a message log, which is stored on the EGM 10, and resynchronize with the PSGS server 60 once communication has become reestablished.

Various message types can be used between the PSGS server 60, the MC 18, and the card reader monitor 30. In developing messages or a messaging system, considerations such as those listed below in Table 1 can be considered.

TABLE 1

| | |
|---|---|
| Message | class name of the message |
| Message Handler | class name of the handler for the message |
| Originator | Who originated this message? |
| Recipient | Who is the intended recipient? |
| Purpose | Why is this message being generated? |
| Transport Mechanism | Along each step in the process, what mechanism is used? |
| Format | What data format is utilized? |
| Data | What data is being sent? |
| Response Expected | What response (if any) can be expected? |
| Actions Taken | What actions will the recipient perform in response? |

Particular messages can be sent between the various components as set forth in Table 2.

TABLE 2

| | |
|---|---|
| Ack | Acknowledges receipt if no particular data is needed |
| Bonus Reward | Sent to PSGS server 60 to update a database with a current bonus event. |
| Bonus Redemption | Sent to PSGS server 60 to update game state at the final conclusion of a game session. |
| Heartbeat | Ensures communications are operative in the PSGS system 8. If heartbeat messages are not regularly received by the various components, the various components may shut down. |
| Machine Authentication | Upon EGM 10 startup, the game authenticates with the PSGS server 60. When received, the PSGS server 60 makes a database update that the particular EGM 10 is active. |
| Machine Transfer | Sent from the PSGS server 60 to a game on the EGM 10 to inform the game of casino configurable options such as timeouts, polling frequencies, which rewards are available to the game, etc. |
| Patron Authentication | When a card-in event occurs, the identification of the patron is verified |
| Patron Bet | A message sent to the PSGS server 60 that enables it to cumulate the total number of individual bets placed by the patron. |
| Patron Bet Response | The PSGS server 60 acknowledges the Patron Bet message and the bet is removed from the game state restoration mechanism. |
| Patron Transfer | Sent from the PSGS server 60 to the EGM 10, this message includes information collected from the player tracking system 40, including their name, ID, status, birth date, etc. |
| Session Begin | Sent from the EGM 10 to the PSGS server 60, this causes the PSGS server 60 to either retrieve a previously stored gaming session, or to create a new session. |
| Session End | Sent to the PSGS server 60 from the EGM 10, this signifies the player has ended the currently active session. |
| Session Transfer | Sent to the EGM 10 from the PSGS 60, this message contains a session that was requested by the EGM 10 with a Session Begin message. |

An example sequence of messages between the EGM 10, the player tracking hardware 20, the player tracking system 40, and the PSGS server 60 Message Sequence is reproduced below.

The message sequence begins when the EGM 10 is initially powered, and it generates a Machine Authentication message. The PSGS server 60 receives the message, authenticates the machine, and sends back a Machine Transfer message. When a card-in event occurs, the card reader monitor 30 generates input to the message controller 18, which in turn generates a Patron Authentication message to the PSGS server 60. After the PSGS server 60 receives the Patron Authentication message, it retrieves the data on the particular patron and sends a Patron Transfer message to the EGM 10, which includes data about the player.

Next, the message controller 18 generates a Session Begin message and the PSGS server 60 generates a Session Transfer message in response, sending the information of either a stored game session that was retrieved from one of the PSGS server databases 62, 64, or a new game session.

When a player places a bet, the EGM 10 generates a Patron Bet message, which is received by the PSGS server 60 and updates the particular database 62, 64. Then the PSGS server 60 generates a Patron Bet Response message and sends it back to the EGM 10. When a patron achieves a target, i.e., a stop on the reward journey, the EGM 1O generates a Bonus Reward message, and sends it to the PSGS server 60. The PSGS server 60 receives the Bonus Reward message, updates its database 62, 64, and generates an Ack message in response.

If a card-out event occurs, i.e., the player removes their player id card, the card reader monitor 30 generates input to the message controller 18. The message controller 18 then generates a Session End message and sends it to the game running on the EGM 10. The game then generates another Session End message and sends it to the PSGS server 60. In response, the PSGS server 60 updates its database 62, 64, and closes out the particular game session that it had previously opened.

The heartbeat messages are on-going and are constantly sent between the message controller 18 and the PSGS server 60. In response, the PSGS server 60 generates and returns an Ack message.

Reward Pool

A reward pool accumulates as a carded player collects tokens at various stops on the reward journey described above. If the player completes the entire reward journey, the amount of the reward pool is determined and awarded to the player. Some variations include requiring that the player complete the entire reward journey within a time period, such as a week or a year.

The reward pool is initialized when a carded player begins to play a game on the EGM 10 that has the reward pool feature. As described above, the reward pool may be a special award only available to players who identify themselves by inserting the player identification card.

Elements used to establish the reward pool are listed below with reference to table 3, and are described in the text following.

TABLE 3

| | |
|---|---|
| Player ID | Unique identifier linking the current player with specific player information in the database. |
| Session ID | Unique identifier linking the current session with specific session information in the database. |
| Minimum Target Value | Configurable parameter that specifies the lowest value that the Final Target Value can be. |
| Maximum Target Value | Configurable parameter that specifies the highest value that the Final Target Value can be. |
| Final Target Value | Value that is randomly chosen between the Minimum and Maximum Target Values. This is the value that the player's Current Value must meet or exceed before the Souvenir Redemption can occur. |
| Targets | Some number, for example 10 to 15 unique, randomly chosen targets residing between 0 and Final Target Value. |
| Value | Value of the target that Current Value must met or exceed before a Souvenir Selection can occur. |
| Achieved | Has this target been achieved yet? |
| Unique Reward Selected | Was the selected Souvenir unique or was it a duplicate of a previously selected one? |
| Date Achieved | The date the souvenir was awarded. |
| Reward ID | Unique identifier linking the current session with specific souvenir information in the database (Is it a key chain? A car tag?). |
| Current Value | A value that correlates to the total coin in that has occurred since the game session was initially begun. Each time a wager occurs Current Value is incremented by a corresponding amount. (ex. A Max Bet is wagered on a nickel denomination machine (9 lines × 10 coins per line = 90 coins × .05 each = 450 cents). Before the wager, Current Value is 250, after the wager the Current Value has been incremented by 90 and is now 340). |
| Last Target Achieved | This equates to the last target in the sequence of Targets above that has actually been achieved. |
| Lucky Coin Triggers | These elements are used in the selection of target values that will be used to trigger minor reward animations and/or bonus rounds. |
| Minimum Games | Configurable parameter that specifies the lowest value that Number of Games can be. |
| Maximum Games | Configurable parameter that specifies the highest value that Number of Games can be. |
| Number Of Games | Value that is randomly chosen between the Minimum and Maximum Games. This is the value that the player's Current Game Number must meet or exceed before a minor reward animation can occur. This does not mean that a player has achieved a reward target value, only that the animation sequence will occur. Each time this goal has been met and the animation triggered (whether a bonus was triggered or not), this value will be reinitialized with a new random number in preparation for the next sequence. At that time a new random number will be selected and retained for future comparison. |
| Current Game Number | This value reflects the number of games played since the last time an anticipatory animation or souvenir bonus animation was triggered and played. Once Current Game Number meets or exceeds Number Of Games, an animation sequence is triggered and the Number Of Games value is reinitialized. |

When a gaming session is established with a carded player, i.e., when the EGM 10 receives a Session Transfer message, described above, the reward pool evaluates to determine if this is a new session. If this is a new session, the reward journey may be customized and particularized for each player. Specifically, the amount of time or distance the entire journey lasts is determined, or may be pre-determined. For instance, the journey may include 10 stops, or targets. The length of the journey could be chosen at random (within given parameters, such as between 8-15). Additionally, the "distance" the player must "travel" to reach each target is determined. This "distance" may be measured by coin-in, number of games played, or some other indicator.

When initializing a reward pool, the following parameters are determined: final target selection, target selection, target initialization, and number of games selection. Once these tasks are complete, the data derived from each will be utilized to complete the initialization of the Reward Pool and to signal the start of game play.

Final target values that have not been initialized may be indicated by containing a predetermined value, such as −1. One method to determine the final target value is to use a random number generator (RNG) in the EGM 10. The RNG can select a number between the provided minimum target value and the maximum target value The selected number then becomes the final target value. For example, the reward journey may end after 1500 games are played.

After the final target value has been selected, a number of targets that will occur on the journey to the final target value is chosen and initialized. The RNG in the EGM 10 can be used to generate the number of targets on the reward journey. For instance, a reward journey may include 12 targets. After the number of targets has been selected, then each is initialized with a sequentially higher, but still randomly selected value. For example, if 12 targets are selected, target 1 is initialized with a value between 0 and a final target value (with an attempt to disperse the targets rather equitably vs. grouping at either end of the spectrum). For instance, target 1 may be forced to be below a number that is 25% of the final target value. Next, target 2 is initialized at a value between target 1 and the final target value. Target 3 is then initialized with a value between target 2 and final target value. These initializations continue until the last target, target number 12, is set to the previously determined final target value.

If instead the reward pool has already been set up from a previous playing session with the carded player, the reward pool is initialized with the previously compiled data elements and the session is restored from the prior session for continued play.

During play, the reward pool tracks the player's progress, i.e., the number of targets that have been achieved. Data of the progress may be stored in dynamic memory of the EGM 10 for continued real-time usage, or stored in non-volatile RAM on the EGM 10 or elsewhere, so that upon power or game failure, the data can be recovered rapidly and easily restored. Of course, data of the progress is also stored in the databases 62, 64 of the PSGS server 60 each time a target is achieved and a souvenir selected.

Each time a player begins a new game, or has a requisite amount of coin-in, depending on the measuring mechanism, the PSGS system 8 determines if the next target on the reward journey has been reached. If the next target has not been reached, the player plays the base game in the EGM 10 (such as video slots) as normal. If however, the current game also causes the player to reach the next (or final) target, the game running on the EGM 10 can indicate that the next (or final) target has been reached. It may indicate this by playing an animation in the reward feature messaging area 112 of the display screen 12, or on another portion of the screen.

At each new game played by the patron, the PSGS server 60 (or the game executing on the EGM 10) determines if the current game is the final target value. If the final target value is reached, the reward pool bonus is determined and awarded to the player. For instance, the reward pool bonus may be determined by a number of unique items that were collected during each incremental target stop on the reward journey. In embodiments of the invention, at each target stop, an item or token is chosen at random by the RNG of the EGM 10, and associated with the player for that particular target. Once the final target has been reached, the number of unique tokens is evaluated. If the player has received the most number of unique tokens (i.e., the RNG chose a different token at each target), then the highest bonus reward is awarded to the player. Lesser amounts can be awarded for fewer number of unique tokens.

After the player has completed the reward journey, the journey can be re-initialized (as described above) to begin a new journey for the player.

If the current game is not the final target value, the PSGS server 60 determines if one of the intermediate target values has been reached. If so, in some embodiments of the invention, one of the tokens is randomly chosen and associated with the player for that target value, as described above.

In some embodiments, a special message or animation can be generated if the next target has not yet been reached, but the PSGS system 60 determines that the target is relatively close. In other words, if the PSGS system 60 determines that the next target will be reached in only a few games, a special message or animation can be shown to the player, which may incite the player to play additional games until the target is reached. In one embodiment, an animated character may move on the screen. For instance, as illustrated in FIG. 3, the bird located in the reward feature messaging area 112 may "swoop" across the screen, which indicates that the next target has nearly been reached.

In other embodiments, the bird may "swoop" after a given number of games are played, which may cause the player to believe they are nearing a target, or may simply stimulate interest in the game. In other embodiments a combination of having the bird "swoop" when the player is relatively close to a target and at other times not based on target vicinity may be used.

Other Types of Awards

Concepts of the invention extend further than the reward journey/incremental target examples that were described above. For instance, multiple journeys may be simultaneously active for a player where the player chooses on which journey to be progressing at any given time. Additionally, other reward features are possible, such as those described below. In the below described awards, distinctions are made between "major" awards and "minor" awards. Such distinctions are not necessary to practice all embodiments of the invention but can be used creatively. For example, in the reward journey award described above, collecting the tokens at each target would be termed a minor award, while redeeming the collected tokens would be termed a major award.

A broad description of the type of reward journey described above is a "collection" or "souvenir" type of award. In such an award, items are collected and, at the end of an award period, a reward given based on the number or types of items collected.

In the embodiment of this type of award described above, each incremental target is met by playing the game a number of times or by using another incremental measure, such as coin-in. In other types of award programs, the player must be playing during a certain time, or on a specific date to be awarded the target item. For instance, a promotion could be created called "Fabulous Fridays", where a player is encouraged to play each Friday for some period of time, for example 3 months. Each time the player has carded play on a separate Friday, the player earns a Friday token. If a Friday passes without the player playing, no token is earned during that period. At the conclusion of the three month period, the number of Friday tokens are counted and an award given based on the number of collected awards. Then, the promotion can be run again, and all of the tokens reinitialized to their beginning state. In some embodiments of the invention, players can check on their progress to see what has been collected at any point during the collection gathering period.

Figure 7:
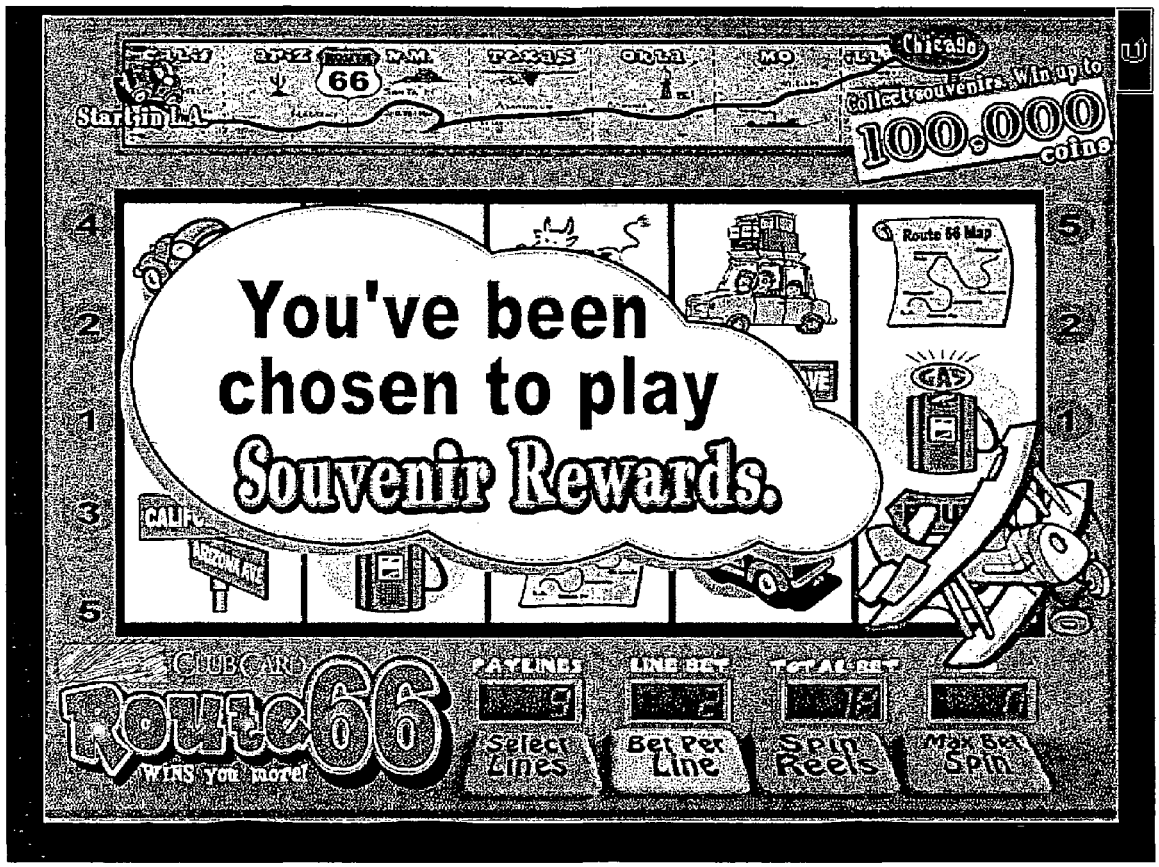
Figure 8:
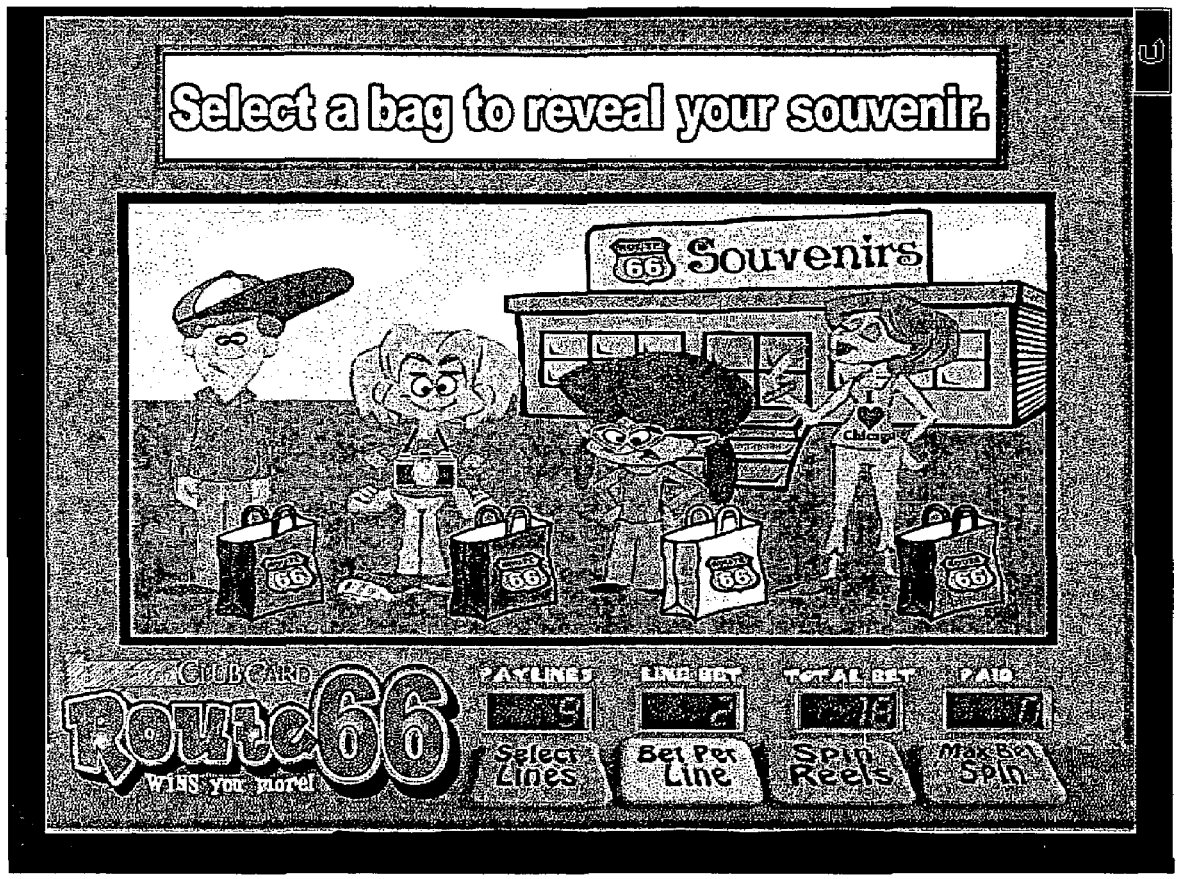
Figure 9:
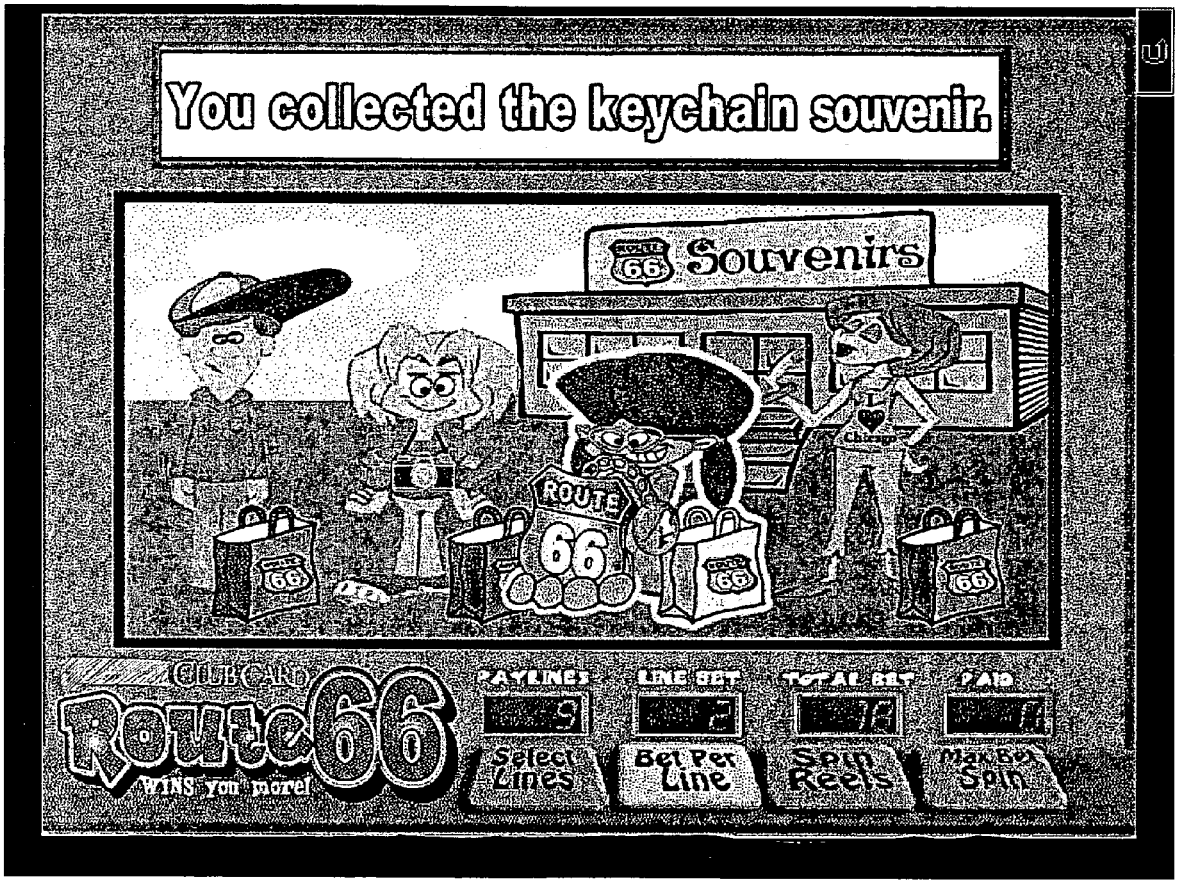
Figure 10:
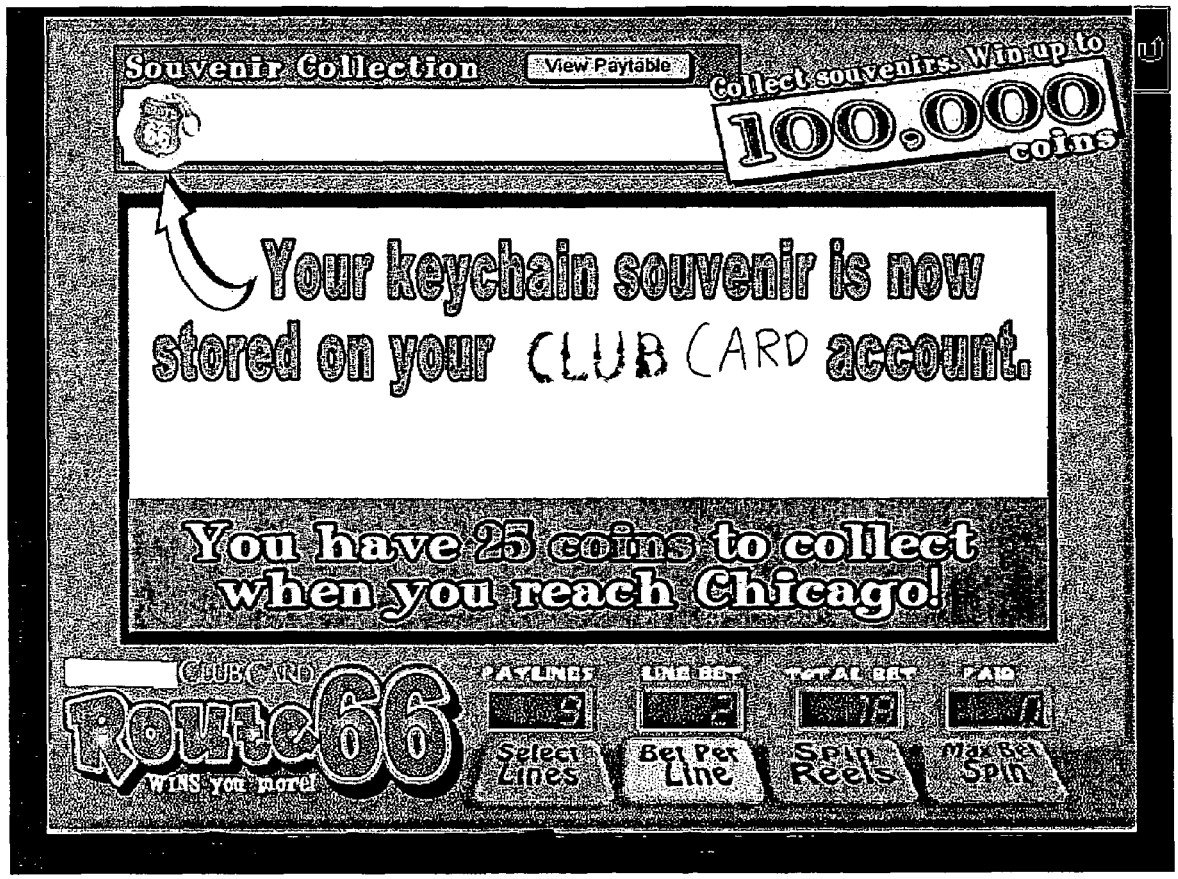
Figure 11:
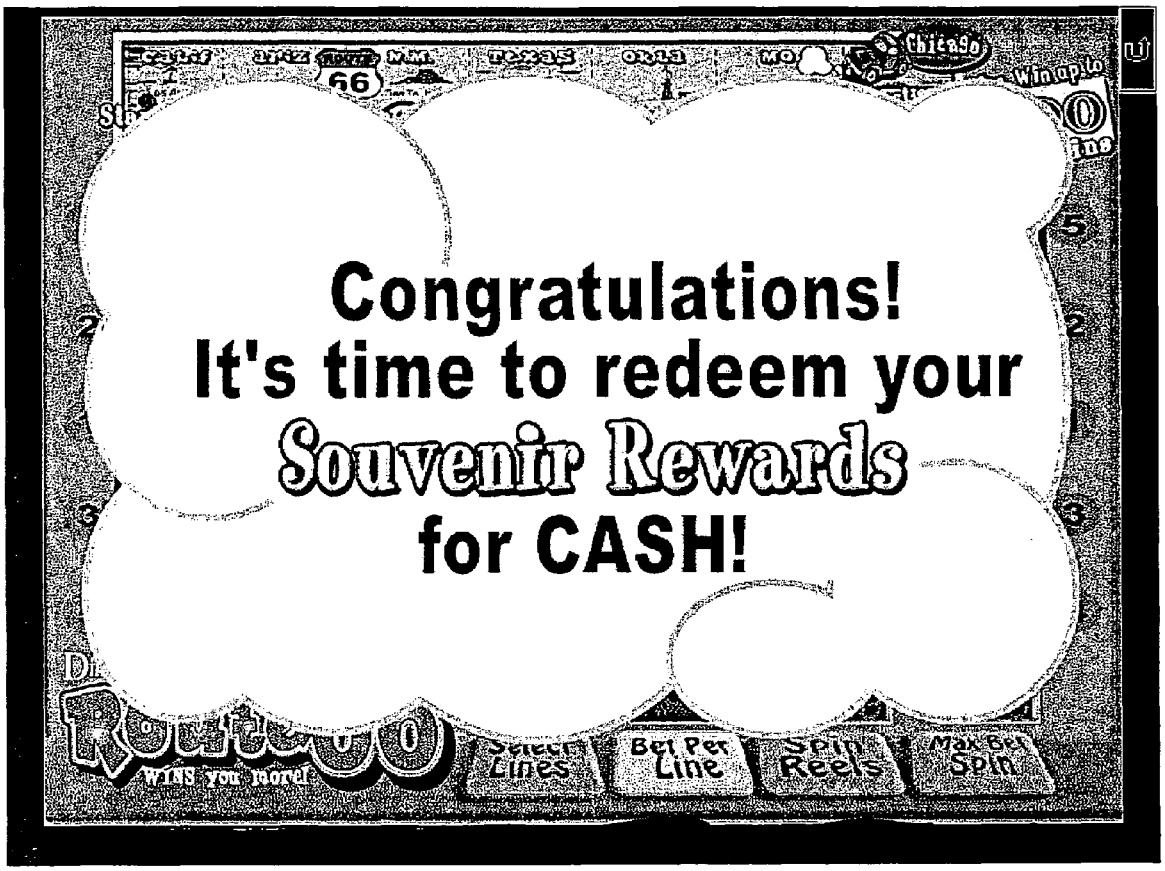
Figure 12:
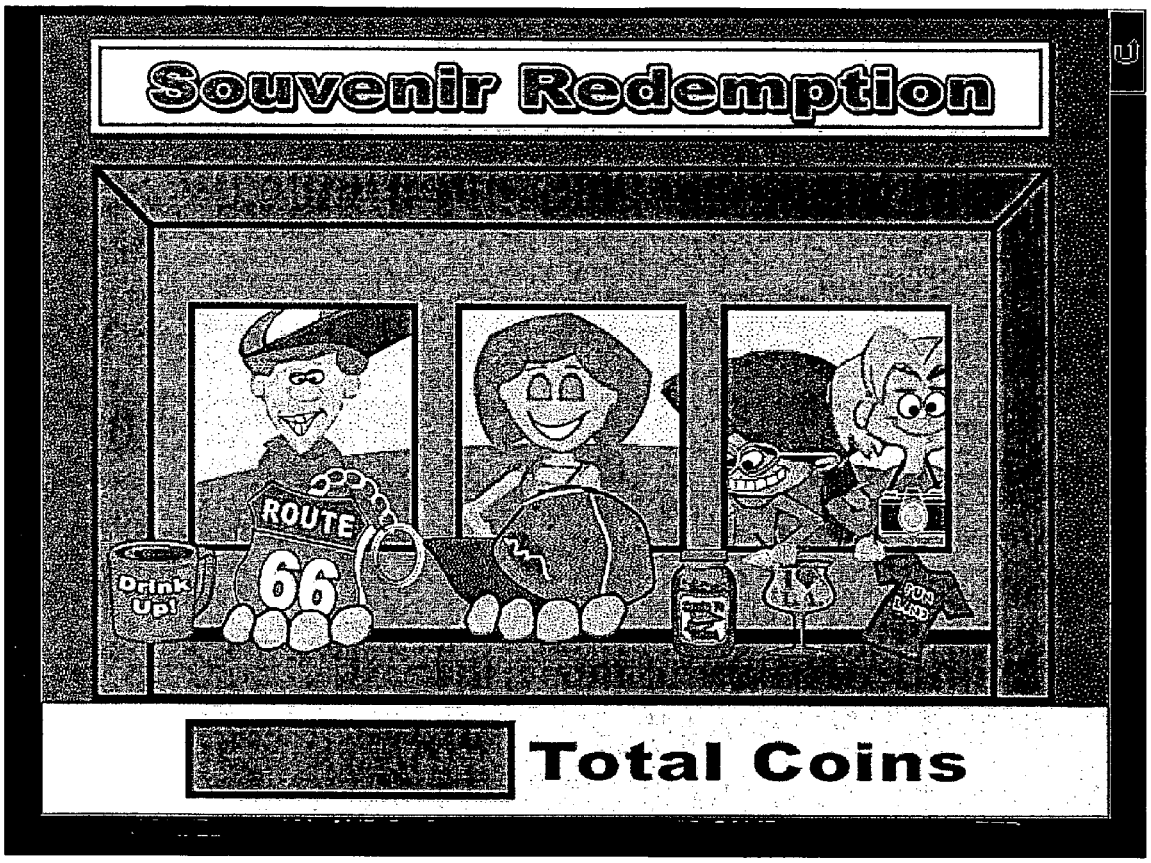
Figure 13:
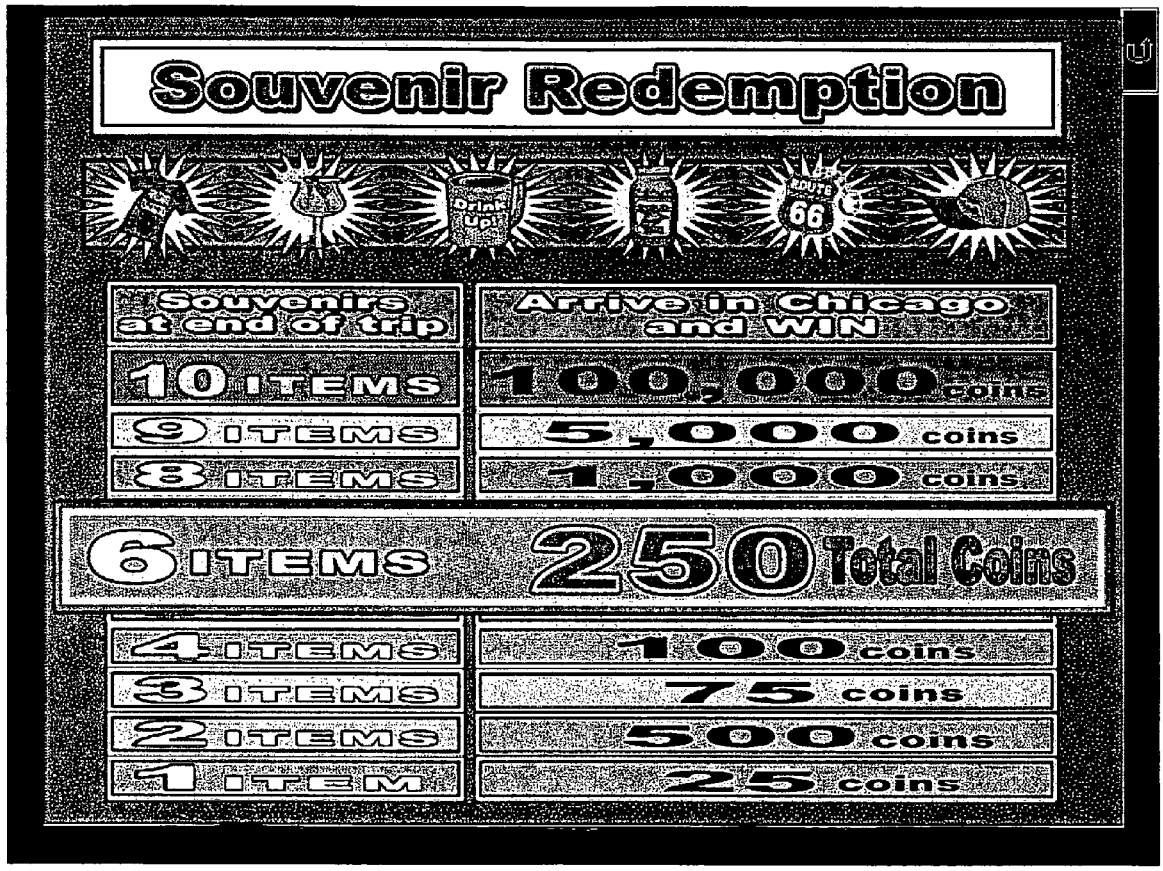

An example collection type reward is illustrated in FIGS. 6-13. In this example, a reward features a trip along Route 66, beginning in Los Angeles and traveling to Chicago. (FIG. 6) The player progresses along the trip by playing more games, or by having a requisite level of coin-in. At certain points along the trip, souvenirs are collected (FIG. 7). The player can make a choice of which bag they would like to open, with each bag "containing" a souvenir (FIG. 8). The player does not know the contents of the bag before choosing it (FIG. 9). The selected souvenir is then stored on the player's account (FIG. 10). After all of the souvenirs have been chosen (when the trip finishes in Chicago), the souvenirs are redeemed (FIGS. 11, 12). The more unique types of souvenirs the player has collected along the journey, the higher the reward will be (FIG. 13).

Another type of reward is a return reward. A return reward feature awards promotional credits that can be redeemed at a later date. Qualifying for the return awards is the minor reward, and the winning and redemption of the promotional or extra credits that occurs at a future date is the major award.

Qualifying for the return award could be achieved by reaching a threshold amount of coin-in. Upon the trigger occurring, the player is notified of their qualification and when they will be able to redeem the reward. The PSGS server 60 stores the fact that the player has qualified for the reward, and its associated data. The major reward for the return reward is based upon a player returning to the casino after the specified period of time and placing their card-in the appropriate game. Upon inserting the card, the game running on the EGM 10 presents a wheel that has values, or some other selection mechanism. The values are provided by the PSGS server 60 to the EGM 10. After spinning the wheel, the customer is informed that they have won a number of promotional credits redeemable at that time. In some embodiments, the credits must be redeemed immediately, and the EGM 10 sends an update to the PSGS server 60 with the status of the player's redemption. The player may receive the credits through a series of screens reinforcing why they received the credits.

Another type of award is a cash drawing award, which features cash drawing tickets that can be redeemed at future date for cash prizes during a cash drawing. The awarding of cash drawing tickets is the minor reward, while participating in the actual cash drawing is the major reward. This type of award is illustrated using FIGS. 14-22

Figure 14:
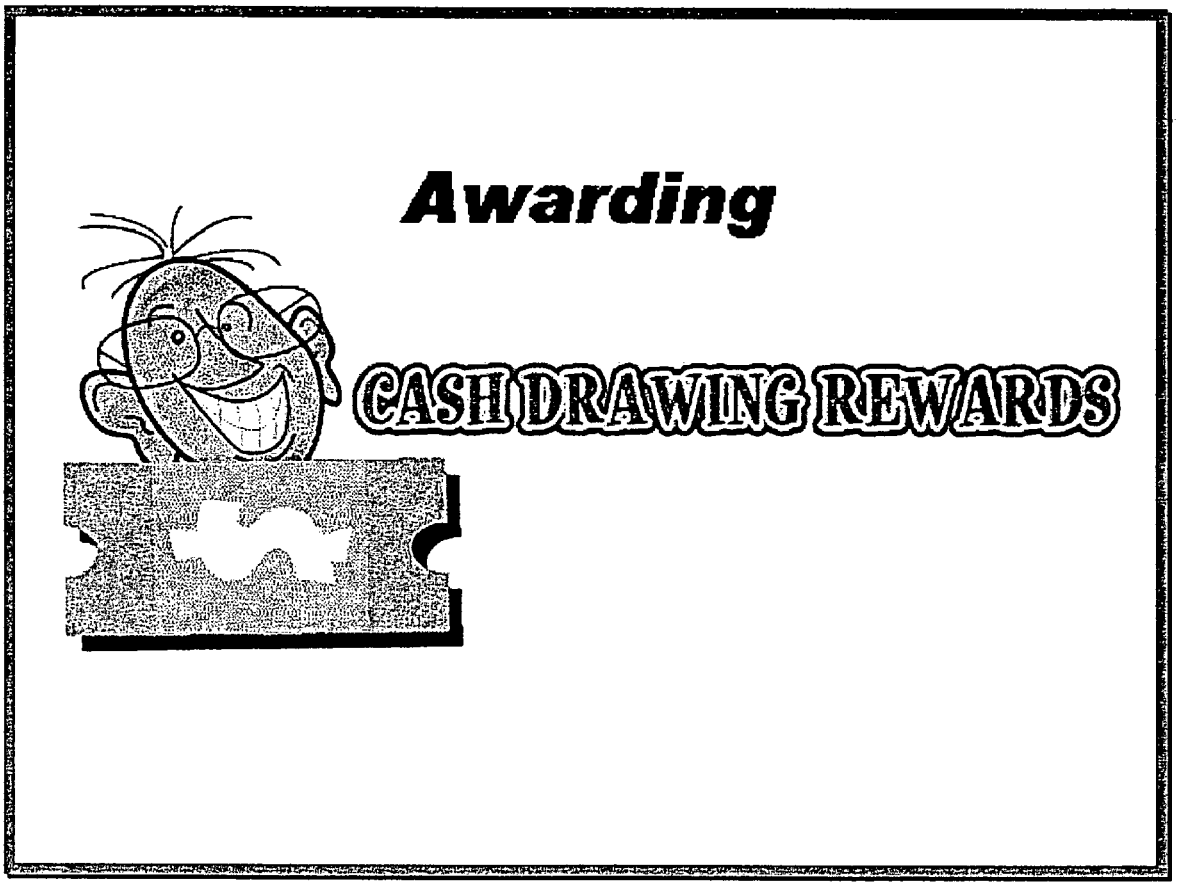
Figure 15:
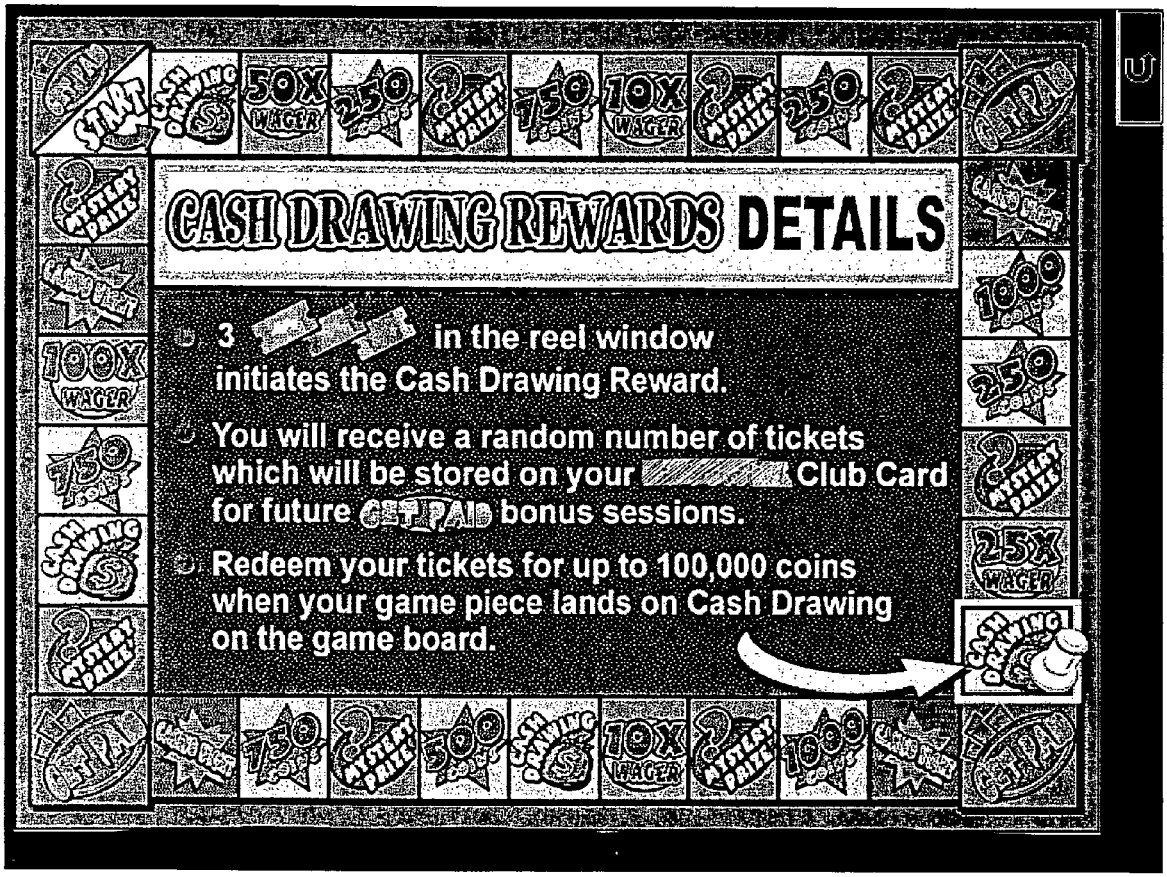
Figure 16:
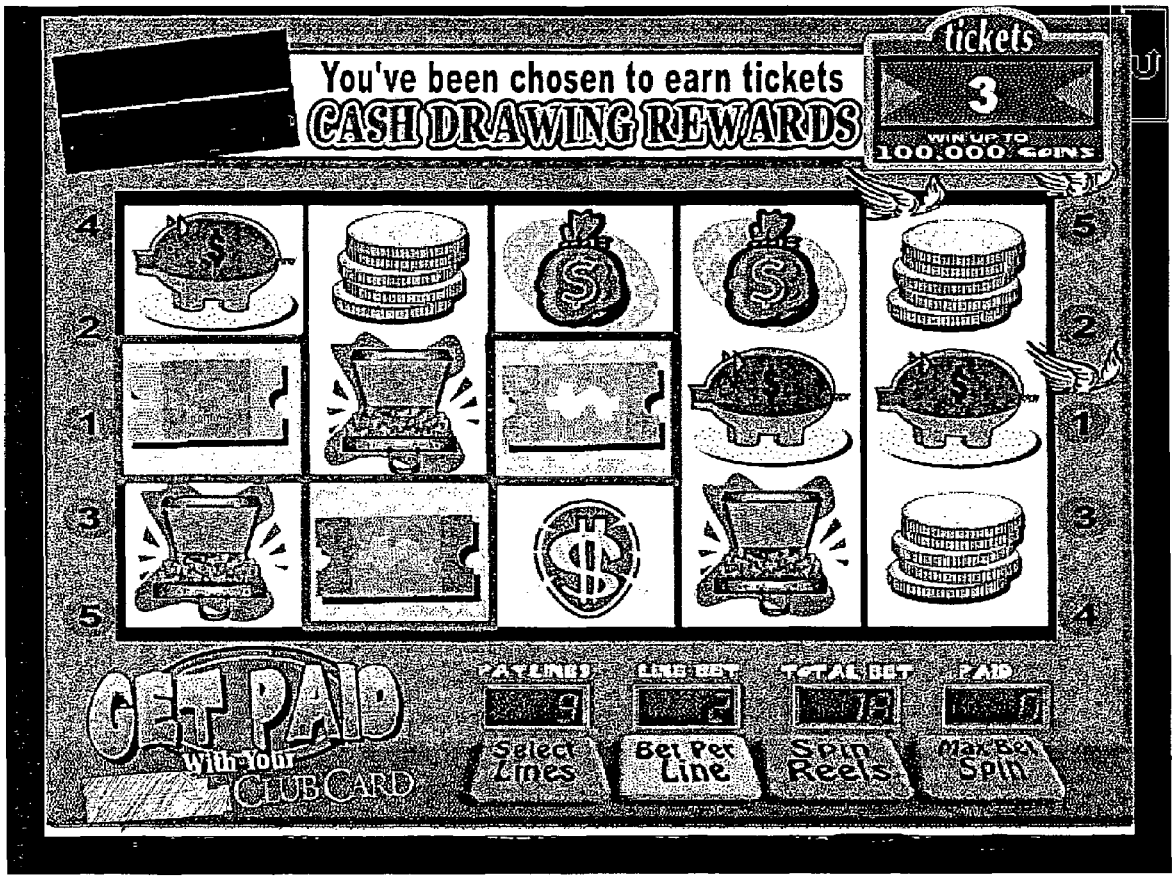
Figure 17:
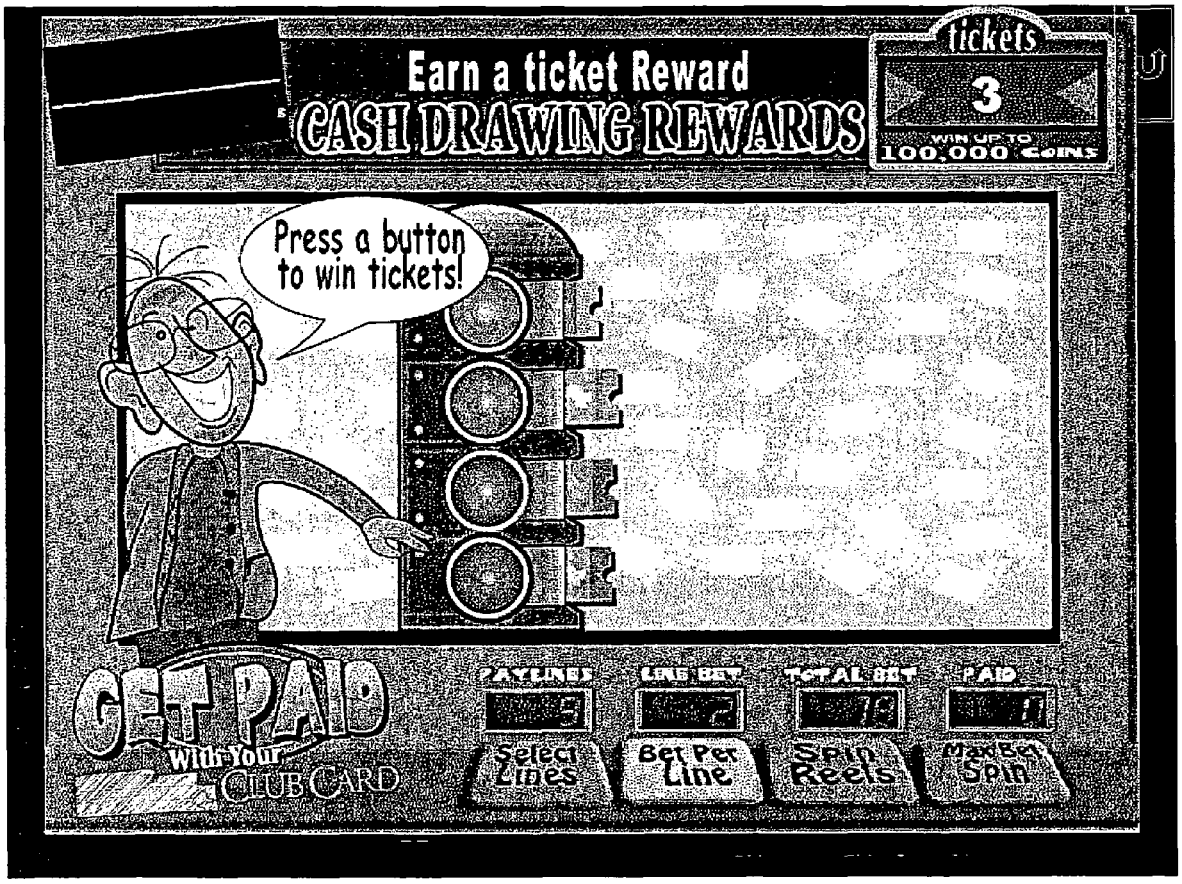
Figure 18:
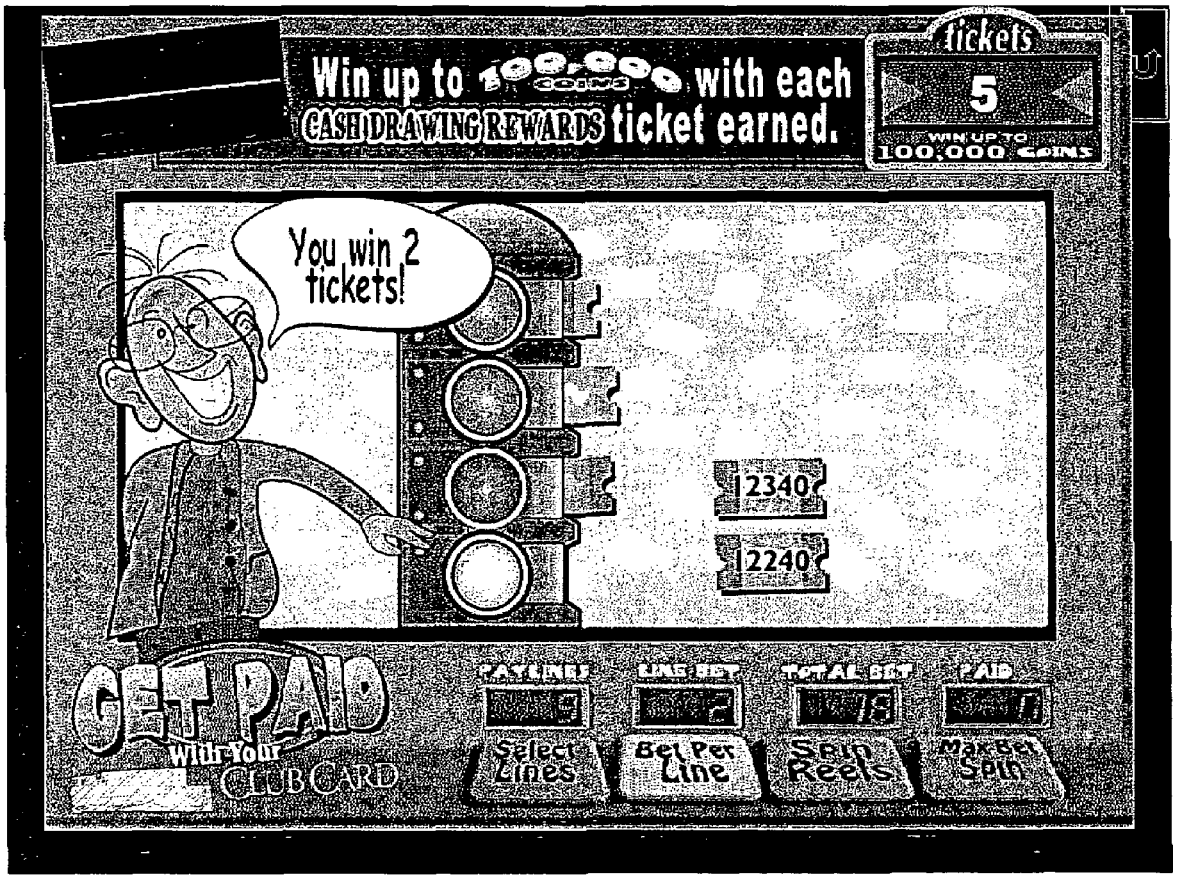
Figure 14:
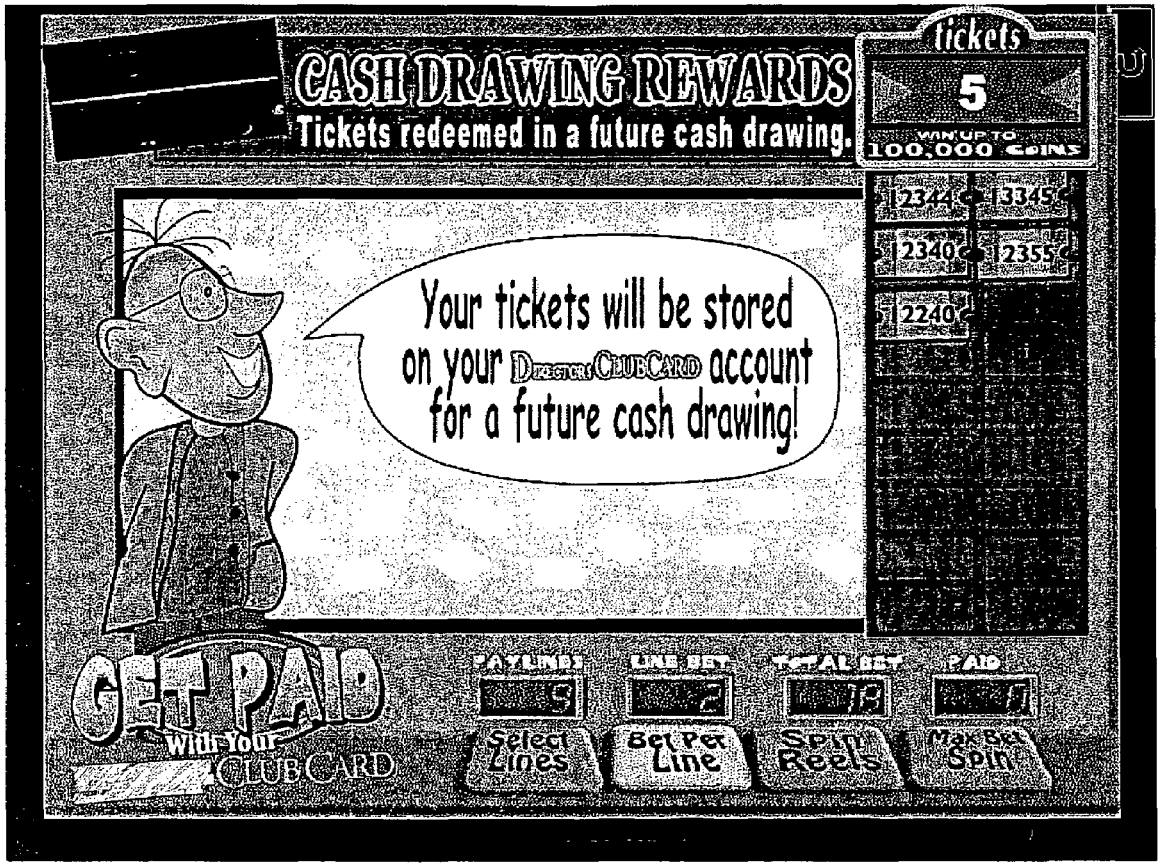

Upon inserting a player club card, the game operating on the EGM 10 the cash drawing reward is initiated (FIGS. 14, 15). The game sets a coin-in (or other) trigger that causes the machine to grant the player an opportunity to win a number of cash drawing tickets. Upon the trigger occurring, the player will proceed to have an opportunity to earn a random number of tickets (FIGS. 16-18). The number of tickets earned by the player is stored on the PSGS server 60 (FIG. 19). The player has the ability to examine their inventory of tickets, as described above. Each ticket may be assigned a series of numbers that are represented on the ticket. In addition to the series of number representing the unique value of the ticket, the player may also assign a color to the ticket during the reward feature. In some embodiments there are four possible colors. There may be a maximum number of cash drawing tickets that can be earned before triggering the cash drawing major Reward. If the maximum number is reached, the PSGS system 8 will no longer provide the player the opportunity to win tickets, until the redemption has occurred.

Figure 20:
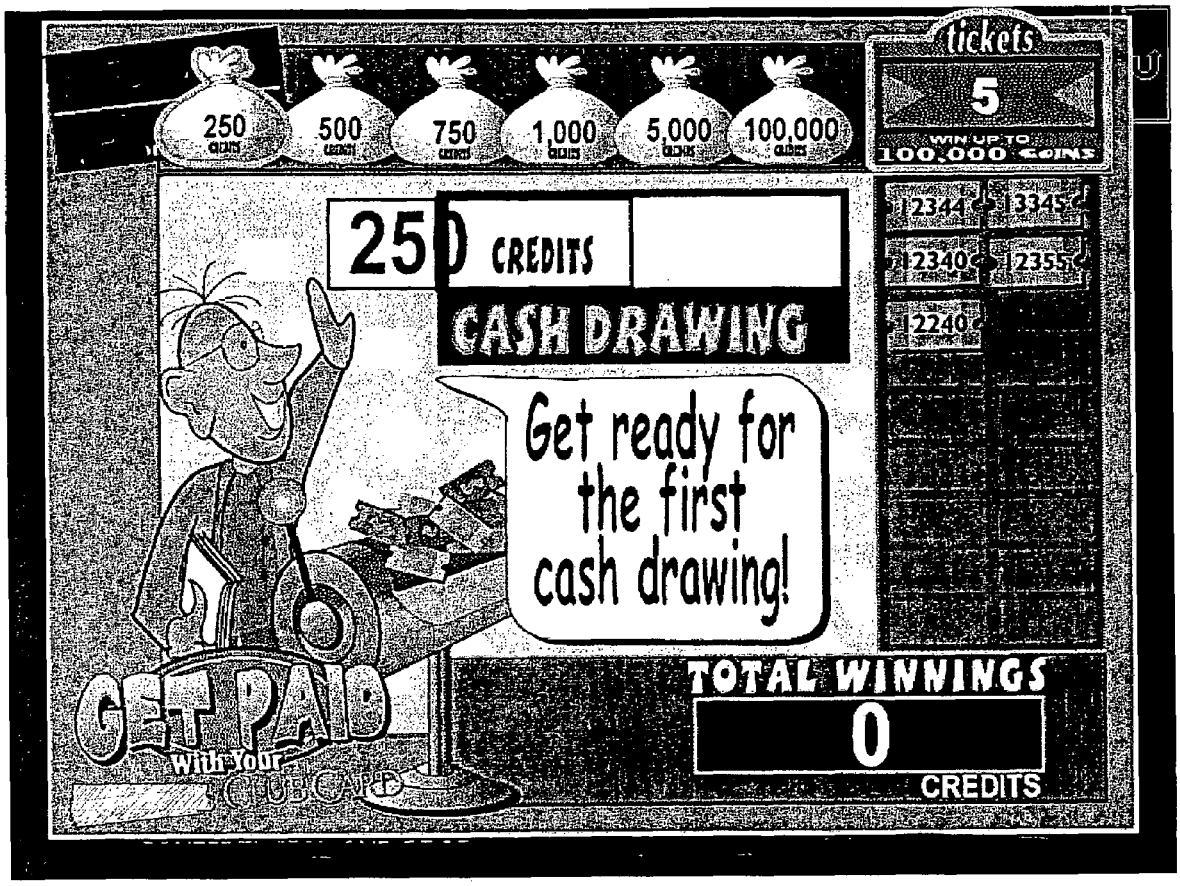
Figure 21:
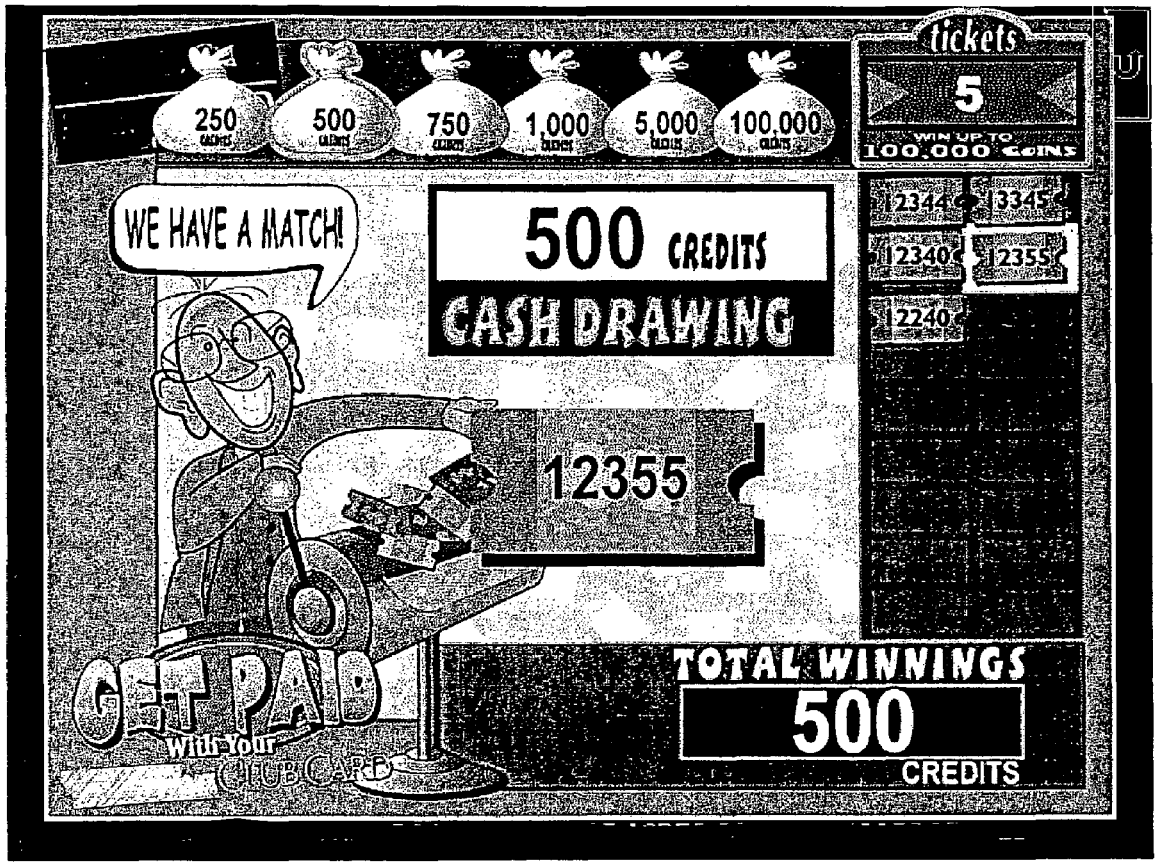
Figure 22:
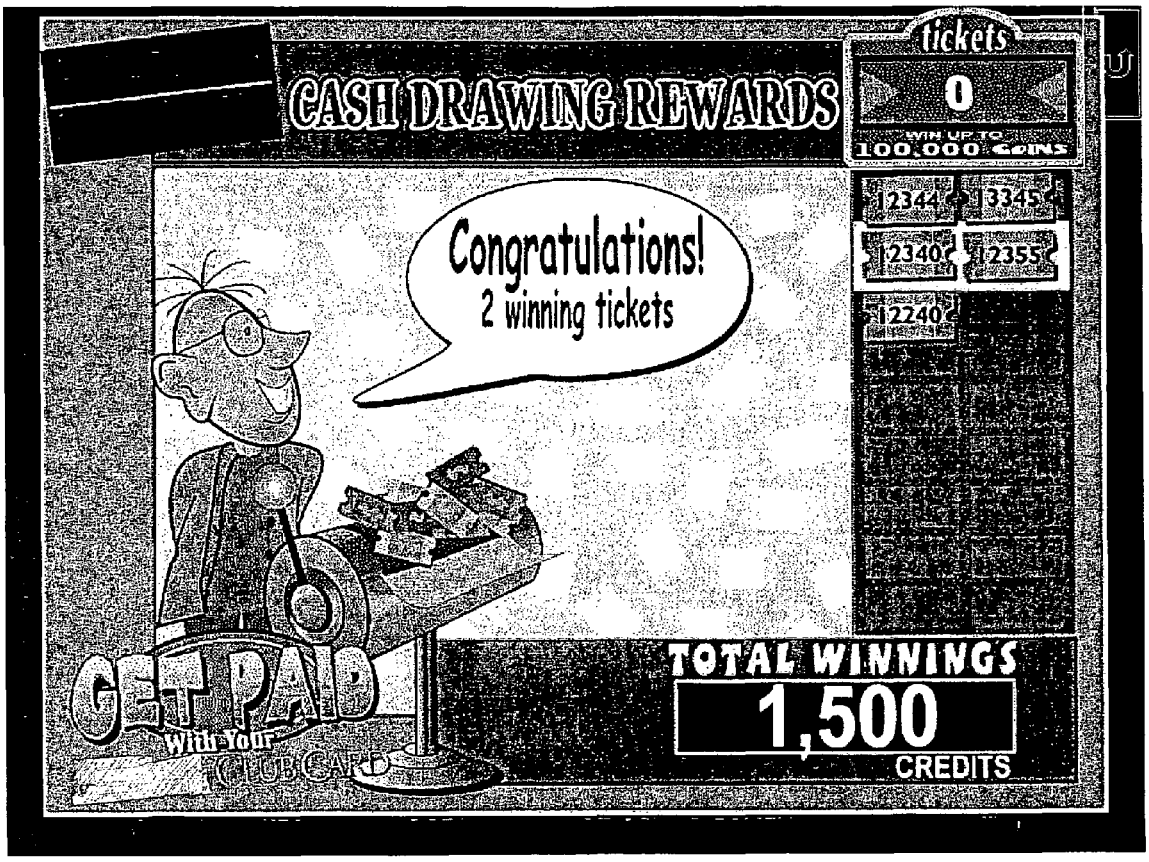
Figure 23:
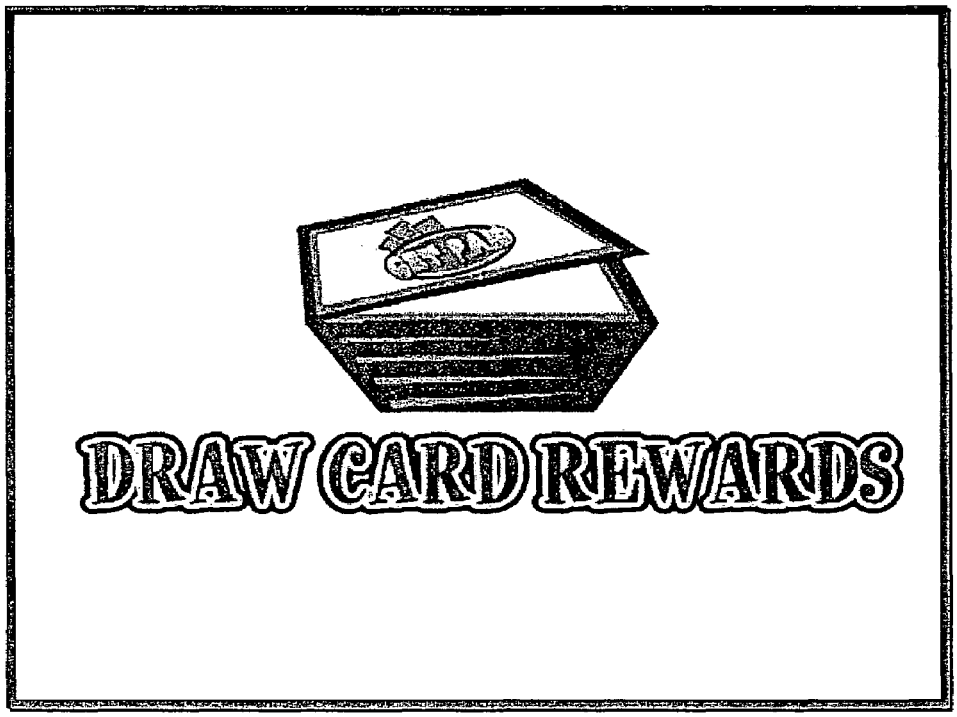
FIGS. 23-29 are example screen shots showing a draw card type reward.
Figure 24:
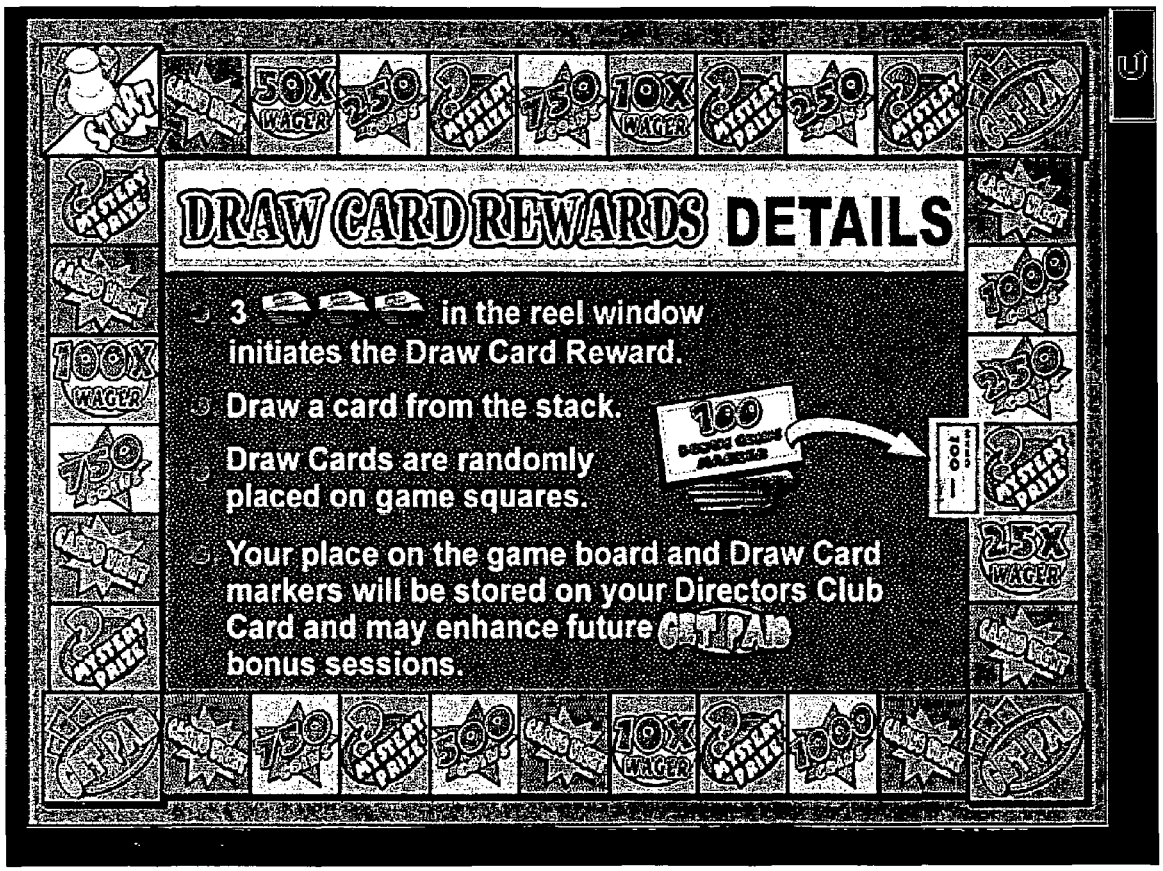

The major reward portion of the cash drawing reward is based upon the player landing on a specific spot on a game board, or some other triggering mechanism during a machine reward round. Upon landing on the spot, the player gets to participate in a cash drawing rewards where different prizes are awarded. In the cash drawing reward, the EGM 10 can simulate a cash drawing, beginning with the lowest amount that will be drawn (FIG. 20). If the machine chooses a player's winning ticket, the value is awarded and the player advances to the next level of prize (FIG. 21). The winning ticket may be eliminated from future cash drawing rewards. If the player does not have a winning ticket, the player advances to the next level without having won the first award. Each level is repeated, and upon completing all levels, the remaining tickets are declared losers. The player can then collect the winnings and begins earning cash drawing rewards tickets all over again (FIG. 22). All non-winning tickets would be forfeited at the conclusion of the drawing.

A draw card reward is another type of possible award, which is illustrated with reference to FIGS. 23-30. The awarding of draw cards is the minor reward while the redemption of draw cards for value is the major award. This reward program operates similar to the cash drawing award described above (FIGS. 23,24).

Figure 25:
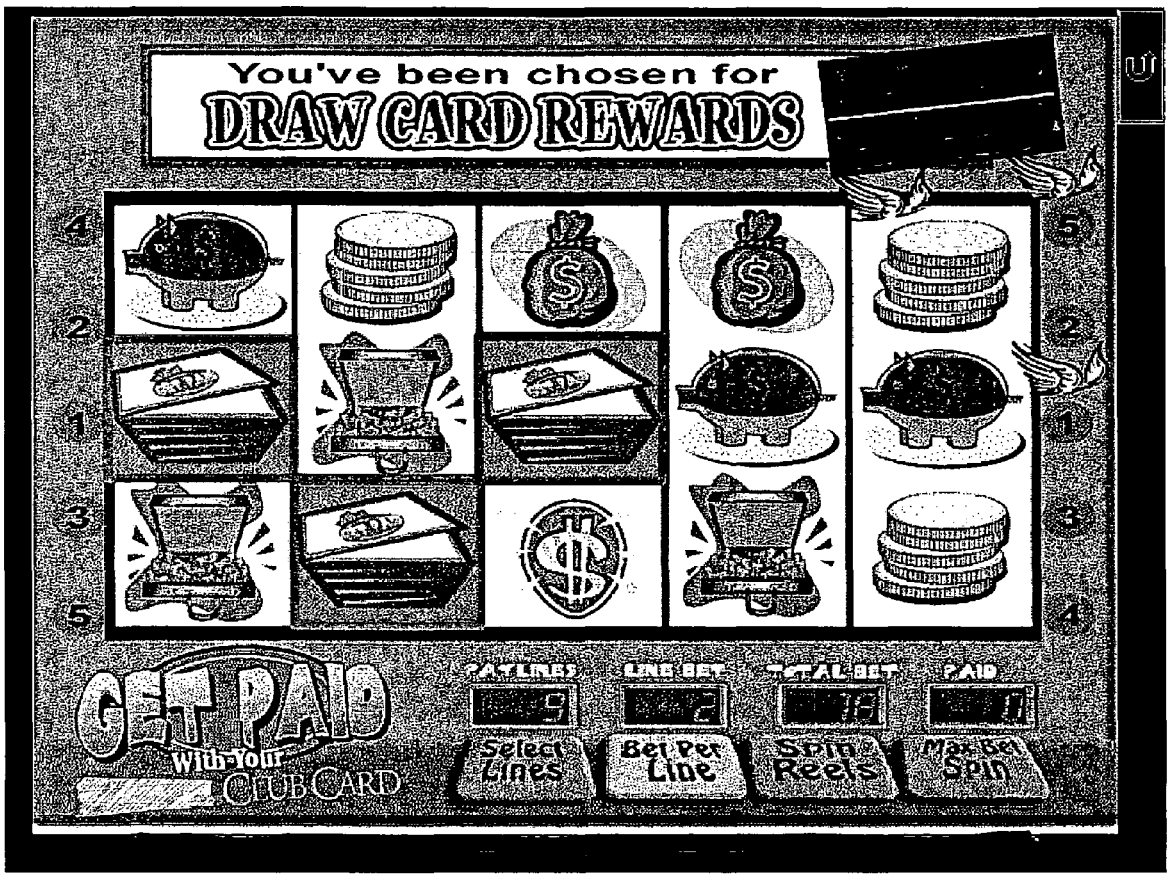
Figure 26:
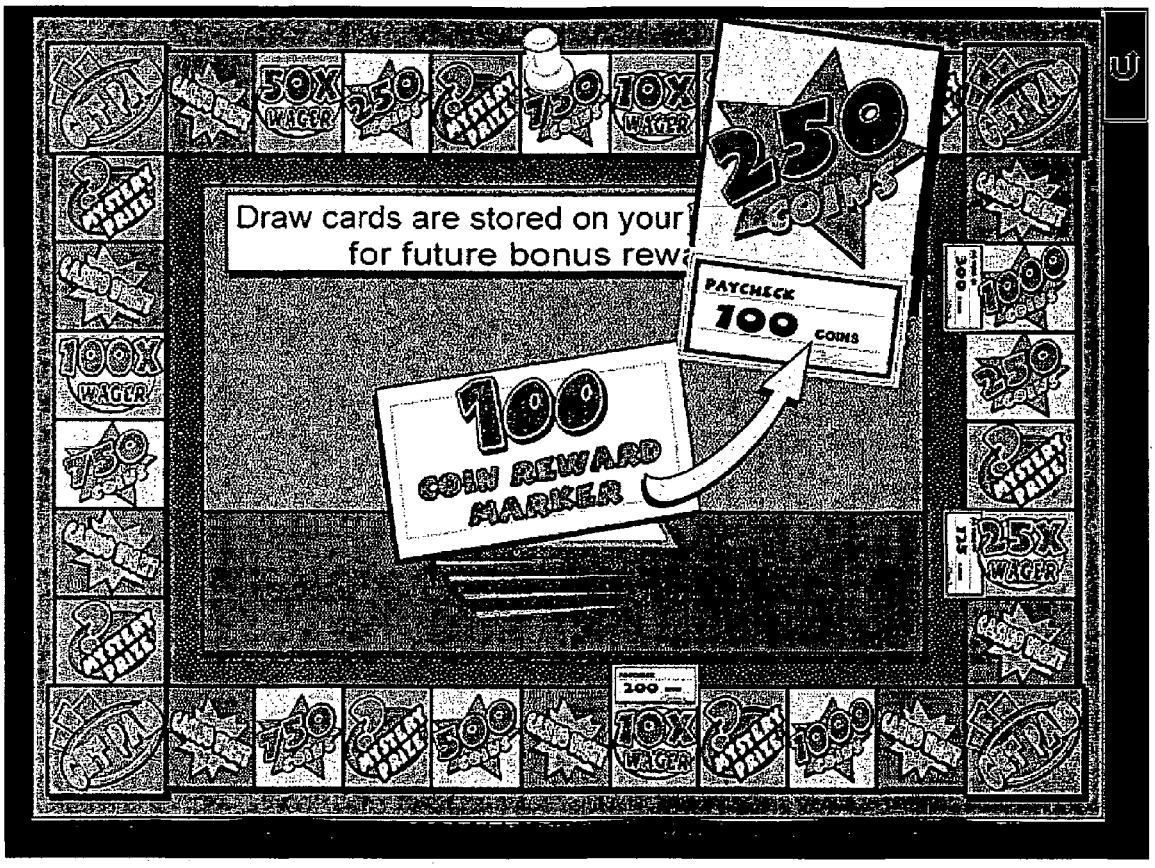
Figure 27:
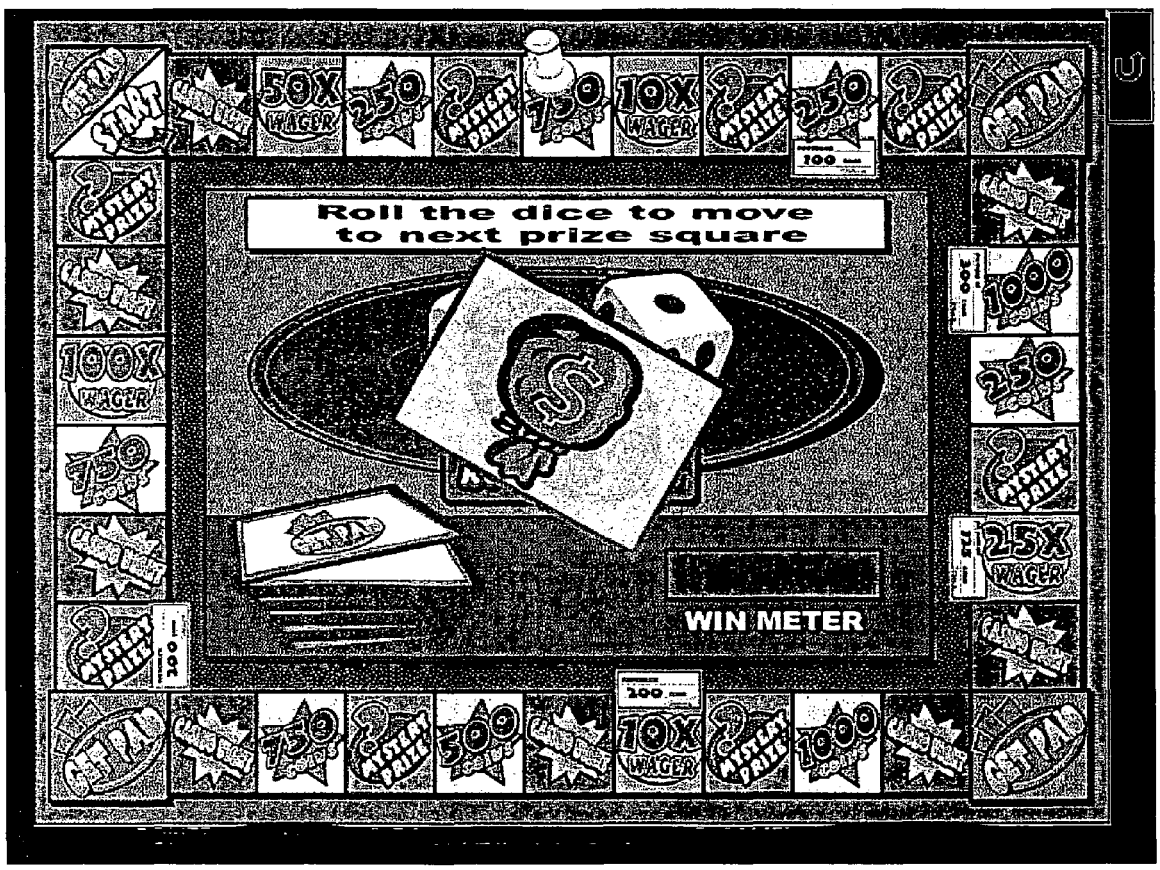
Figure 28:
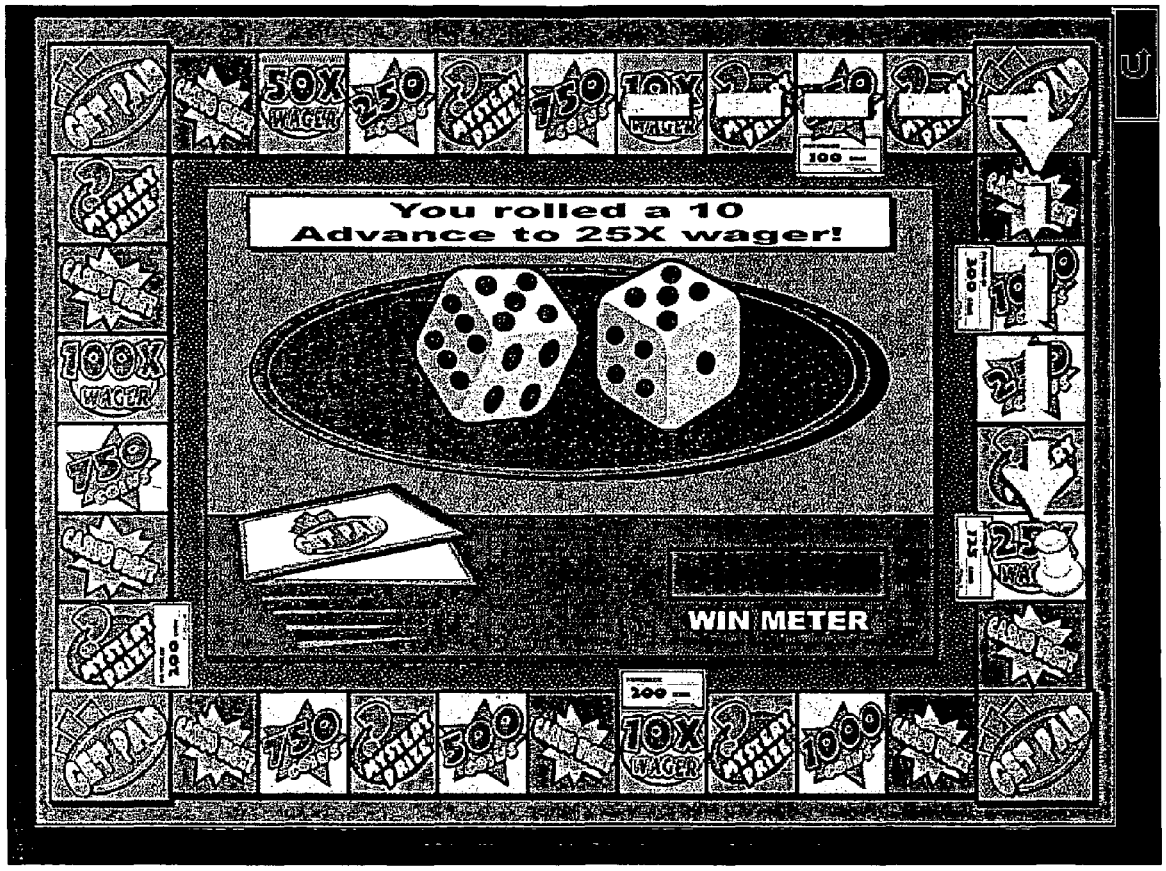
Figure 29:
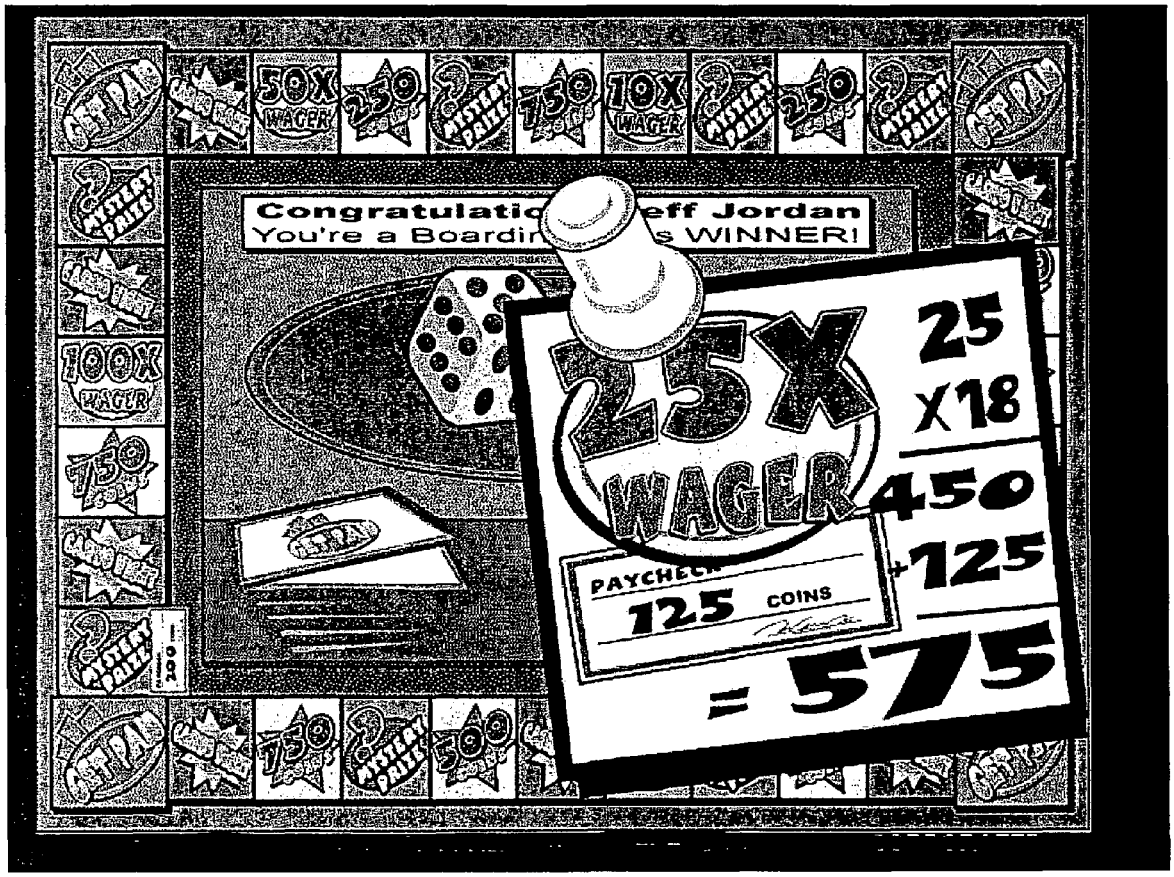

Upon a trigger occurring, the game running on the EGM 10 machine shows a draw ticket and places it on the game board (FIGS. 25, 26). The location and value of the draw cards are stored in the PSGS server 60. The major reward is based upon the player landing on a specific spot on game board during a machine reward round. The machine reward round occurs on a scatter pay. A player causes an action, for example rolls dice to determine which spot they land on (FIGS. 27,28) Upon landing on the spot, the player wins an amount based upon the base game reward. In addition to the base game pay, the player can collect additional cash prizes for having a draw card in that particular location (FIG. 29). As a player moves past locations with draw cards, the draw cards may be removed from the game board.

As described above, various embodiments of the invention are possible, and the scope of the invention is not limited to the example embodiments described herein, but rather by the scope of the following claims.

What is claimed is:

1. A gaming network comprising:

a gaming device including a base game and a bonus game, the bonus game playable by players identified to the gaming device;

player tracking hardware structured to identify a player of the gaming device;

a player tracking system structured to store data about gameplay of the player of the gaming device; and a player processing system structured to record a present state of the bonus game, wherein the present state of the bonus game can be recalled from stored data during a subsequent gaming session, the bonus game including a series of trigger events in which the bonus game advances to a non-initial state upon the occurrence of a trigger event, at a non-initial state a player identified to the gaming device acquires an award randomly selected from a group of possible awards, and at the end of the bonus game the player is rewarded based on the number or types of awards acquired.

2. The gaming network of claim 1 wherein the bonus game has an initial state and more than one non-initial state.

3. The gaming network of claim 2 wherein the bonus game is structured to configure a state of an award to one of the non-initial states.

4. The gaming network of claim 3 wherein the bonus game is structured to configure a state of the award for the player to one of the non-initial states in a present gaming session if the bonus game was in one of the non-initial states in a previous gaming session for the player.

5. The gaming network of claim 1, further comprising message controller resident on the gaming device.

6. The gaming network of claim 5, further comprising a messaging center in the player processing system.

7. The gaming network of claim 6 wherein the message controller and the messaging center are structured to communicate using XML messaging.

8. A gaming network comprising:

a gaming device having a primary game and a bonus game wherein the bonus game is playable only by a player identified to the gaming device;

player tracking hardware coupled to the gaming device and structured to identify a player of the gaming device;

a player tracking system coupled to the gaming device and structured to store data about gameplay of the player of the gaming device; and a player specific gaming server coupled to the player tracking system and coupled to the gaming device, the gaming server structured to record session information of the bonus game played on the gaming device by the player wherein the present state of the bonus game can be recalled from stored data during a subsequent gaming session, the bonus game having a series of trigger events in which the bonus game advances to a non-initial state upon the occurrence of trigger event, at a non-initial state a player identified to the gaming device acquires an award randomly selected from a group of possible awards, and at the end of the bonus game the player is rewarded based on the number or types of awards acquired.

9. The gaming network of claim 8, further comprising:

a message controller on the gaming device, and a messaging process operative on the gaming device.

10. The gaming network of claim 9 wherein the message controller communicates with the messaging process using discrete messages.

11. The gaming network of claim 8 wherein the gaming device is structured to communicate to the player tracking system over a first communication network and wherein the gaming device is structured to communicate to the player server over a second communication network.

* * * * *